United States Patent [19]

Ide et al.

[11] Patent Number: 4,639,114

[45] Date of Patent: Jan. 27, 1987

[54] IMAGE-FORMING APPARATUS WITH AUTOMATIC AND MANUAL PAPER FEED MODES

[75] Inventors: Fumitō Ide, Zama; Hidenori Mochizuki, Yokohama, both of Japan

[73] Assignee: Kabushiki Kaisha Toshiba, Kawasaki, Japan

[21] Appl. No.: 664,291

[22] Filed: Oct. 24, 1984

[30] Foreign Application Priority Data

Oct. 25, 1983 [JP] Japan ..... 58-198332
Oct. 26, 1983 [JP] Japan ..... 58-199124
Oct. 31, 1983 [JP] Japan ..... 58-202587

[51] Int. Cl.[4] ..... G03G 15/00
[52] U.S. Cl. ..... 355/35 H; 355/3 R
[58] Field of Search ..... 355/35 H, 14 SH, 3 R; 271/256, 262, 263

[56] References Cited

U.S. PATENT DOCUMENTS 3,970,384 7/1976 Yamamoto et al. ..... 355/14 SH
4,190,246 2/1980 Sasuga ..... 355/3 SH X
4,204,668 5/1980 Yanagawa ..... 355/3 SH X
4,279,504 7/1981 Brown et al. ..... 355/3 SH X
4,349,269 9/1982 Okada ..... 355/3 SH X
4,382,674 5/1983 Miyoshi et al. ..... 355/3 CH X
4,383,756 5/1983 Hanamoto et al. ..... 355/3 SH X
4,503,407 3/1985 Ogura ..... 355/14 SH X
4,503,960 3/1985 Koeleman et al. ..... 355/14 SH X

*Primary Examiner*—A. C. Prescott
*Attorney, Agent, or Firm*—Cushman, Darby & Cushman

[57] ABSTRACT

An image forming apparatus includes a first sheet supply cassette which is used for automatic feeding and a second sheet supply cassette which is used for either automatic or manual sheet feeding. Both of these cassettes are detachably mounted and house sheets to be used in paper coyping. The second sheet supply cassette has a sheet supply guide which can be switched between a first position for manual feed and a second position for automatic feed. A structure is also provided for selecting which of the first and second cassettes are to be used for feeding, and a control structure generates control signals in response to the condition of the sheet supply cassettes. After the sheets are supplied, an image is formed on the sheets which have been fed.

2 Claims, 58 Drawing Figures

(EXAMPLE DISPLAY C)

(EXAMPLE DISPLAY D)

(EXAMPLE DISPLAY E)

(EXAMPLE DISPLAY F)

(EXAMPLE DISPLAY G)

(EXAMPLE DISPLAY H)

(EXAMPLE DISPLAY I)

(EXAMPLE DISPLAY J)

(EXAMPLE DISPLAY K)

(EXAMPLE DISPLAY L)

(EXAMPLE DISPLAY M)

(EXAMPLE DISPLAY N)

(EXAMPLE DISPLAY O)

(EXAMPLE DISPLAY P)

FIG. 58 (SELECT CASSETTE 22a) (PAPER EMPTY)

IMAGE-FORMING APPARATUS WITH AUTOMATIC AND MANUAL PAPER FEED MODES

BACKGROUND OF THE INVENTION

This invention relates to an image-forming apparatus and, more particularly, to an image-forming apparatus improved in that a variety of information obtained during the copying operation is effectively displayed.

Recent image-forming apparatuses, such as copy machines, include microcomputers and are provided with a display section for presenting a variety of visual information upon the operation of the copy machine, for example, the present paper feed mode, i.e., an automatic or manual feed mode, the amount of paper stored in a cassette or i.e., if the cassette is empty or not, or how to cope with jamming if it occurs.

In a conventional image-forming apparatus such as a copy machine, before copying, it is necessary to set up a particular paper feed mode. This includes selecting either an automatic feed mode or a manual feed mode. The selection of the paper feed mode is made by setting a manual guide through which paper is manually inserted.

However, even when the manual guide is set in the copy machine, if the cassette for automatic paper feeding is set, the copy machine displays that the latter cassette is set. For this reason, an operator, after seeing the display, may be confused due to the inability to determine whether the manual feed mode or the automatic feed mode is set up in the copy machine.

In the manual feed mode, to simplify the copying operation, the copy machine detects the insertion of paper along the manual guide and starts the copying operation.

In the case that the operator can not recognize which paper feed mode is being executed in the copy machine, as mentioned above, he or she may erroneously insert paper into the manual guide even if the machine is not in the manual feed mode. In such a case, the copy machine will not start the copying operation. Then, the operator may erroneously believe that something is wrong with the machine.

The same thing is true in the automatic feed mode when paper is fed manually.

In recent copy machines, a plurality of cassettes is provided for different paper sizes. In use, the operator selects the appropriate cassette according to the desired paper size. In this respect, the above problem is more serious.

In operating a copy machine with a plurality of cassettes, the selected cassette is mechanically coupled with the feed roller to pick up and to feed paper sheet by sheet to each succeeding stage of the copy machine.

As the copying operation proceeds, there is less and less paper in the cassette until finally the cassette is empty.

To detect if the cassette is empty, a microswitch or a photosensor as a detecting means is provided for each cassette. When the cassette is empty, the copy machine visually informs the operator of the fact.

The displayed message, however, does not tell which cassette is empty, or whether or not the empty cassette is one of those coupled with the feed roller, and if it is coupled to the feed roller, it does not tell which cassette is empty.

Therefore, when "empty" is visually displayed, the operator, after seeing it, can not quickly find the empty cassette.

Further, in the conventional copy machine, the empty signal is not displayed until the cassette is selected. Therefore, it is impossible to find whether the empty cassette is present or not before the copy machine is operated.

In a copying machine with a plurality of cassettes, a select switch, for example, is operated to select the intended cassette and to operatively couple it with a feed roller to feed paper in the cassette sheet by sheet.

The conventional copy machine is further provided with, for example, a microswitch to check whether or not the paper is reliably fed from the cassette or if the fed paper is smoothly transferred. When a jam is detected by the switch, a display window provided in the operation pan 1 of the copy machine visually indicates one of the following:

(1) Occurrence of a jam (2) Symbol showing the selected cassette, and a symbol representing a jam.

From such a visual presentation, however, the operator can not know which cassette suffers from jamming, and which cassette is feeding the jammed paper.

For example, in the case of (1) above, only the presence of a jam is given. In the case of (2), the cassette displayed is the one being used before jamming started. Therefore, the operator can not know whether or not the present jam is due to the pape fed from that cassette.

SUMMARY OF THE INVENTION

It is, therefore, an object of the present invention to provide a new and improved image-forming apparatus which can distinctively display whether the feed mode already set up in the apparatus is an automatic feed mode, or a manual feed mode.

Another object of the present invention is to provide an image-forming apparatus which can distinctively display when the paper-storing case for storing image-forming medium is empty.

Still another object of the present invention is to provide an image-forming apparatus which can distinctively display the information of how to cope with a jam when it occurs.

According to the present invention, there is provided an image-forming apparatus comprising image-forming medium supplying means, image-forming means, and display means. The image-forming medium supplying means has an automatic feed mode in which the image-forming medium stored in the image-forming medium storing means for automatic feeding is automatically fed to another part of the image-forming apparatus. It is also operable in a manual feed mode in which the image-forming medium is manually fed thereto from an image-forming medium storing means for manual feeding. The image-forming means forms an image on the image-forming medium as fed from the supplying means. The display means distinctively displays which mode, the automatic feed mode or the manual feed mode, the image-forming medium is using to fed the image-forming means.

BRIEF DESCRIPTION OF THE DRAWINGS

The present invention can be understood by reference to the accompanying drawings, in which:

FIG. 58 shows a timing chart useful in explaining the switching operation of the displayed figure.

DETAILED DESCRIPTION OF THE PREFERRED EMBODIMENT

[Description of Overall Copy Machine]

A description will first be given on the structure of an overall copy machine incorporating the present invention.

Figure 1:
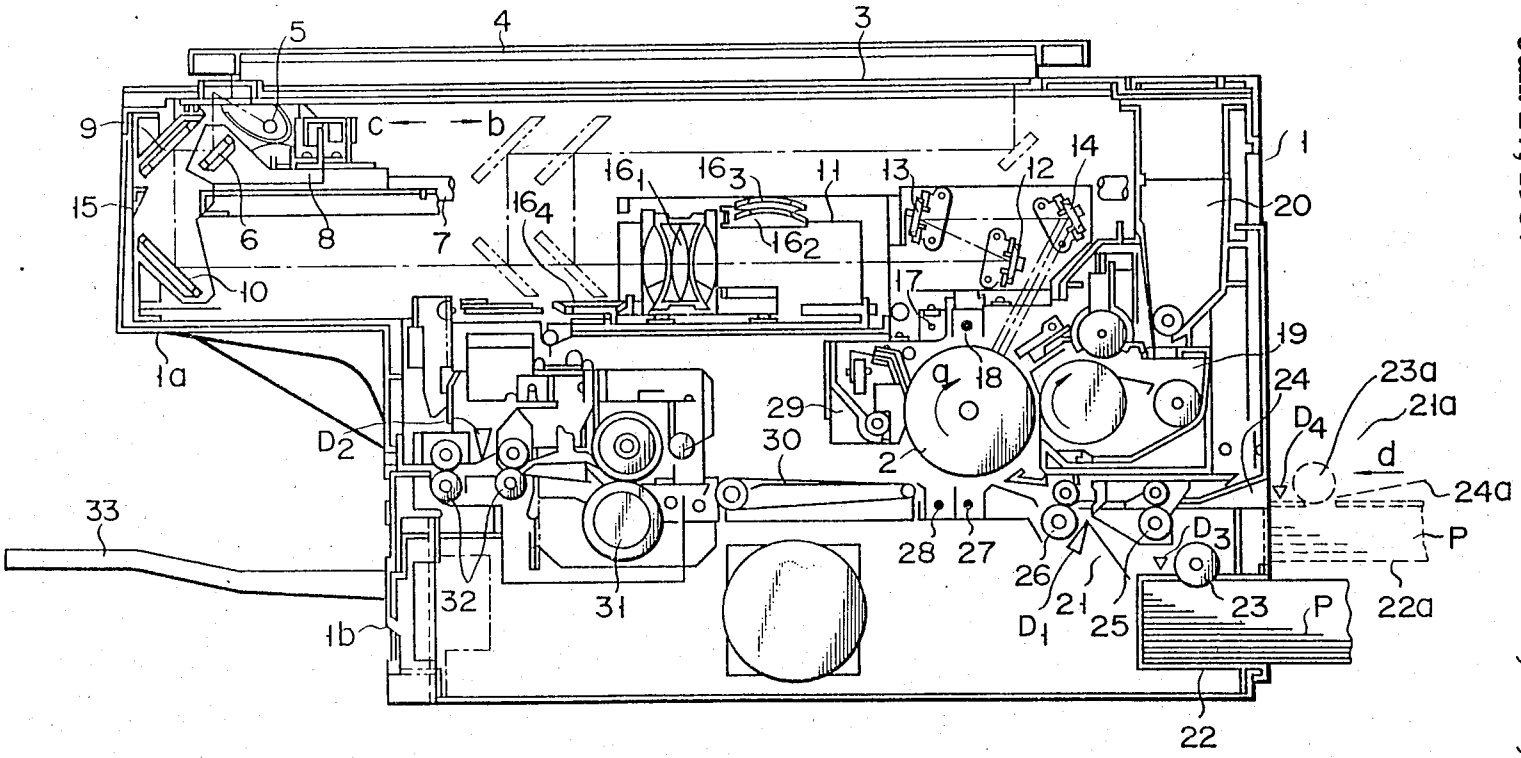
FIG. 1 shows a longitudinal cross-sectional view of a copy machine which is an embodiment of the present invention.

Reference is made to FIG. 1 illustrating a longitudinal cross-section of the copy machine. As shown, a photosensitive drum 2 rotating in the arrow direction a is located at the center of a main frame 1. Mounted to the top of the main frame 1 is a table 3 made of transparent glass and on which an original to be copied, such as a document, is placed. A cover 4 is hingedly coupled at one side with the table 3. The cover 4 is used for fixedly covering a document when it is placed on the table 3 for its copying purposes. Provided under the table 3 is a scanning means including an exposure lamp 5 and a mirror 6. The scanning means is mounted to a first carriage 8 which reciprocately moves along a guide rail 7 in the arrow directions b and c.

The light beam emitted from the exposure lamp 5 is reflected by the mirror 6; passes an optical path containing mirrors 9 and 10, a lens unit 11, and fixed mirrors 12, 13 and 14; and reaches the photosensitive drum 2 to form thereon an image contained in the document. The mirrors 9 and 10 are mounted to a second carriage 15 which moves at half the speed of that of the first carriage 8 and in the same direction. When the first and second carriages 8 and 15 move to the right as viewed in FIG. 1, the surface of the photosensitive drum 2 is slit exposed by the light containing the document image information. The carriages, and the optical components cooperatively make up the scanning means.

The lens unit 11 contains a main lens $16_1$ movable in both directions b and c, and further additive lenses $16_2$–$16_4$ which are rotatably supported to be located on both sides of the main lens $16_1$. The movement of the lenses $16_1$–$16_4$ in the directions b and c changes the magnification of the image. By selectively placing the additive lenses $16_2$–$16_4$ on the optical path, the focal distance is adjusted. The copy machine of this example is designed to enlarge and reduce the image size in two steps.

The first and second carriages 8 and 15 are each moved in the directions b and c by means of wires coupled in a stretched manner therewith through pulleys. The wires are drivingly coupled with a scanning motor. The wires, the pulleys and the motor are not illustrated for the sake of simplicity.

A DC motor is used for the scanning motor and is rotated in synchronism with an induction motor for driving other loads than the carriages.

Many functional components are arranged around the photosensitive drum 2. Of those components, a quenching lamp 17 quenches residual charges on the photosensitive drum 2. A charger 18 uniformly charges the surface of the photosensitive drum 2. The photosensitive drum 2, after being charged, is optically scanned by the scanning means to have an electrostatic latent image formed on the surface thereof. A developer 19 forms a toner image. A toner hopper 20 supplies toner to the developer 19.

A feeder 21 for feeding paper under the photosensitive drum 2 is provided under the main frame 1. The feeder 21 is provided with a cassette 22 mountable on the side of the main frame 1, a feed roller 23, a manual feed port 24 and a feed roller 25.

The cassette 22 serves as a paper holding means and holds therein a stack of paper. The feed roller 23 serves as a paper-feeding means, and picks up paper sheet by sheet from the cassette 22 and feeds it to the succeeding stage. In the manual feed port 24, paper is manually inserted directly or though a manual guide to be described later. Then, the inserted paper is fed into the main frame 1 through the feed roller 25.

The feeder 21 is further provided with a manual feed cassette 21*a* as an optional unit. In use, the manual feed cassette 21*a* is set at the manual feed port 24. The manual feed cassette 21*a* includes a feed roller 23*a* for picking up paper P from a cassette 22*a* and feeding it into the main frame 1, and a manual guide 24*a* slidable in the arrow direction d so as to allow retraction of the feed roller 23*a* from the cassette 22*a*.

Thus, when the manual feed cassette 21*a* is set in the copy machine, the copy machine is operable in an automatic feed mode for automatically feeding paper from the two cassettes 22 and 22*a*, and a manual feed mode using the manual guide 24*a*.

Paper fed from the manual feed cassette 21*a* (or through the manual feed port 24) and paper supplied from the cassette 22 are each fed under the photosensitive drum 2, through an aligning roller pair 26. The cassette 22*a* also constitutes a paper-holding means. The feed rollers 23, 23*a* and 25, and the aligning roller pair 26 constitute the paper feed means.

An arrangement for detecting if the cassette 22 or 22*a* is empty, will be described.

The cassettes 22 and 22*a* are respectively provided with detection switches $D_3$ and $D_4$ as detecting means (see FIG. 1).

Figure 4:
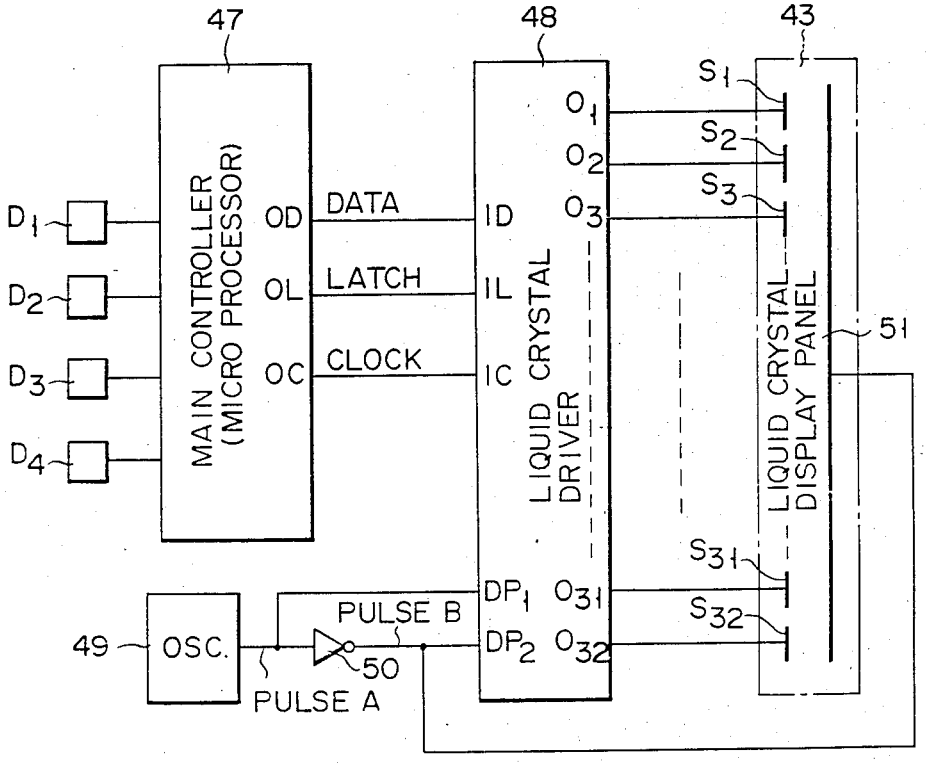
FIG. 4 schematically illustrates an arrangement of a control circuit in use for the copy machine of FIG. 1.

These switches $D_3$ and $D_4$ operate when the paper in the cassettes 22 and 22*a*, has run out and respectively send empty signals P to a main control section 47 (see FIG. 4). Upon receipt of the empty signals from the switches, the main control section 47 prohibits a subsequent copying operation, while at the same time controls a display section so as to provide a necessary display.

Disposed downstream of the feeder 21 are a transfer unit 27 and a separator 28, both facing the photosensitive drum 2. The transfer unit 27 transfers the toner image formed on the photosensitive drum 2 onto the paper coming from the aligning roller pair 26. The separator 28 separates the paper bearing the transferred image from the photosensitive drum 2.

A cleaning unit 29 is provided facing the photosensitive drum 2, and removes residual toner which is left on the surface of the photosensitive drum 2.

A cleaning unit 29 is provided facing the photosensitive drum 2, and removes toner left on the surface of the photosensitive drum 2.

The paper separated by the separator 28 is transferred to a fixing unit 31 such as a heat roller, by means of a transfer unit 30. The transfer unit 30 contains a plurality of endless belts. The fixing unit 31 heats and presses the paper bearing the toner image, and fixes the toner image on the paper.

The paper, after being fixed, goes outside to a tray 33 outside the main frame 1, through an exit roller 32.

The main frame 1 is composed of an upper unit 1*a* and a lower unit 1*b*. These units are rotatably coupled at one ends thereof. In use, these units are coupled together, with a boundary therebetween along the transfer path of paper. The upper unit 1*a*, for example, can be turned upward at a predetermined angle from the lower unit 1*b*, the coupled ends acting as a fulcrum, to expose the paper transfer path for maintenance.

The upper unit 1*a* contains the photosensitive drum 2, the table 3, the scanning means, the charger 18, the developer 19, the feed roller 25, the upper roller of the aligning roller pair 26, and the feeder 21. The lower unit 1*b* contains the cassette 22, the feed roller 23, the feed roller 25, the lower roller of the aligning roller pair 26, the transfer unit 27, the separator 28, the transfer unit 30, the fixing unit 31, and the exit roller 32. The manual feed cassette 21*a* is mounted to the upper unit 1*a*.

The image-forming means is comprised of the photosensitive drum 2, the quenching lamp 17, the charger 18, the developer 19, the transfer unit 27, the separator 28, the cleaning unit 29, the transfer unit 30, the fixing unit 31, and the exit roller 32.

[Control Panel]

Figure 2:
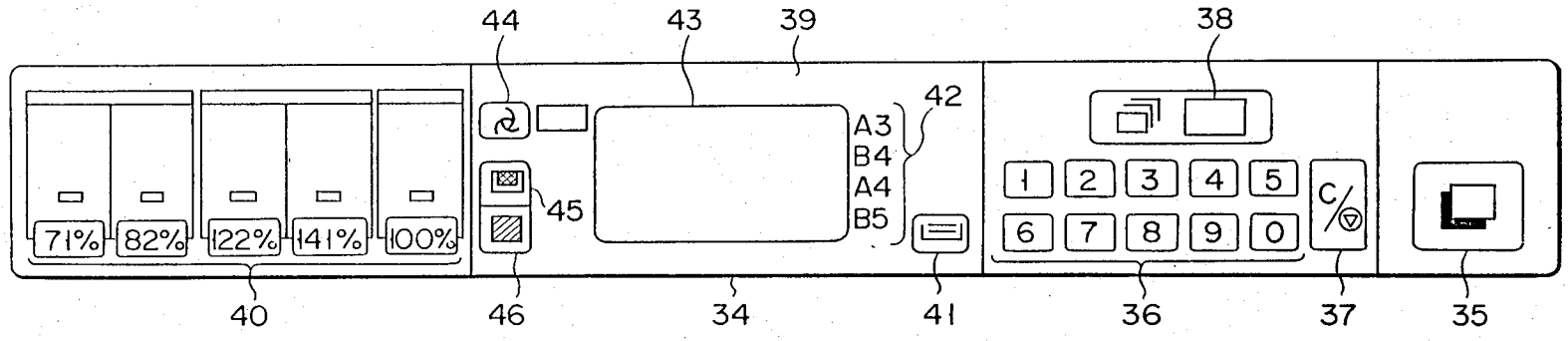
FIG. 2 is a view illustrating a control panel used in the copy machine of FIG. 1.

Reference is made to FIG. 2 illustrating a control panel 34 provided on the upper surface of the main frame 1. In the control panel 34, a print key 35 starts the copying operation. A ten key 36 consists of a plurality of keys for inputting a desired number of copies. A clear key 37 stop the consecutive copying operation caused by the ten key 36, and clears the number of copies as set by the ten key 36. A display section 39 contains a display section 39 as a display means, a key group 40 for magnification, and a select key 41 as a select means. The print display 38 displays the number of copies as first set by the ten key 36, and the number of copies displayed is decreased one by one for each copying operation. The display section 39 is provided with a paper size display for displaying the size of paper contained in the cassette, and a liquid crystal (LC) display 43 to be described later.

Located near the display section 39 are an automatic exposure (AE)/manual exposure (ME) mode select key 44, and density setting keys 45 and 46 for setting the desired copy density.

Upon operation of the AE mode select key 44, the density of a document placed on the table 3 is optically sensed, and the exposure is set in the exposure lamp 5. As a result, a clear copy is obtained according to the sensed density of the document. When the AE mode select key 44 is operated again, a manual exposure (ME) mode is selected. In this mode, the exposure amount can manually be set according to the number of operations of the keys 45 and 46, or for a duration of the density setting key 45 or 46.

The key group 40 sets the desired magnification of the copied image. For setting the magnification, or for discovering paper size conversions and the magnifications as indicated by a percentage, the operator pushes the corresponding keys. For example, when the paper size conversion is A3–B4, and the desired magnification is 122%, the key marked as 122% on the top and the key located above it are pushed. When those keys are pushed, the moving speeds of the first and second carriages 8 and 15 are changed, and the position of the main lens $16_1$ is changed. Further, the additive lenses $16_2$–$16_4$ are selectively moved towards or retracted from the optical path. Through such an operation of the copy machine, the document is copied at the desired magnification.

The select key 41 is operable only when the manual feed cassette 21*a* is used. By operating the select key 41, either of the cassettes 22 and 22*a* is selected. In the following description, it is assumed that the manual feed cassette 21*a* is attached to the copy machine.

Normally, the lower cassette 22 is automatically selected when the power switch is turned on. For selecting the upper cassette 22*a*, the operator must select the select key 41. For selecting the lower cassette 22, the select key 41 is pushed again.

[Display Panel]

Figure 3:
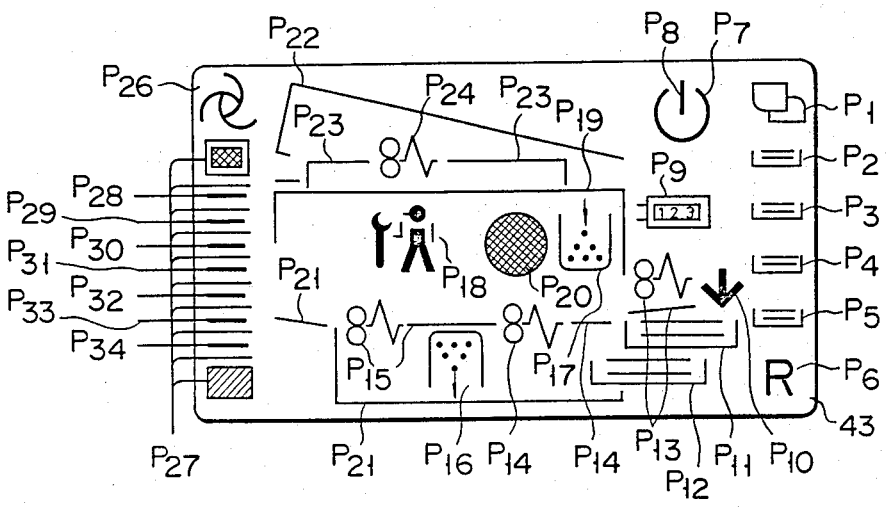
FIG. 3 shows the details of a display panel provided in the operation panel of FIG. 2.

As shown in FIG. 3, the LC display 43 has an arrangement of a plurality of display patterns $P_1$–$P_{24}$ and $P_{26}$–$P_{34}$. The meanings of those display patterns are tabulated in Table 1. Symbols of the display patterns in the table are the same as those in FIG. 3.

TABLE 1

| Display patterns | Contents |
|---|---|
| $P_1$ | Indicates that the machine is ready for manual paper feed. |
| $P_2$–$P_5$ | Indicates the size of paper stored in a selected cassette. |
| $P_6$ | Indicates that the longitudinal direction of the paper, in which the paper is transferred, is set. |
| $P_7$ | Indicates that the machine is ready for copy. |
| $P_8$ | Indicates that copying is impossible. This is displayed together with the |

TABLE 1-continued

| Display patterns | Contents |
|---|---|
| | $P_7$ above. |
| $P_9$ | Indicates that the total counter is not set. |
| $P_{10}$ | Indicates that the cassette 22 or 22a is empty. |
| $P_{11}$ | Indicates that the cassette 22a is attached to the machine. |
| $P_{12}$ | Indicates that the cassette 22 is attached to the copy machine. |
| $P_{13}$ | Indicates that a paper feed error has occurred in the manual feed mode. |
| $P_{14}$ | Indicates that a jam has occurred near the paper feeder or that a paper feed error has occurred. |
| $P_{15}$ | When displayed together with $P_{14}$, indicates that a separation error has occurred. Paper is separated from the photosensitive drum 2 or is jammed at the entrance of the fixing unit 31. When solely displayed, it indicates that jamming has occurred near the exit of the fixing unit 31. |
| $P_{16}$ | Indicates that the toner collector is full of toner collected by the cleaning unit 29. |
| $P_{17}$ | Indicates that the toner hopper 20 is empty. |
| $P_{18}$ | Indicates that something is wrong with the copy machine. |
| $P_{19}$–$P_{22}$ | Provides symbolic representations of the main frame and the photosensitive drum. |
| $P_{23}$ | Indicates that the document feeder is attached to the machine. |
| $P_{24}$ | Indicates that a document is jammed in the document feeder. |
| $P_{26}$ | Indicates that the copy machine is in the automatic feed mode. |
| $P_{27}$ | Provides an exposure guide. |
| $P_{28}$–$P_{34}$ | Indicates an exposure amount as set. |

When the manual feed cassette 21*a* is attached to the machine, and if the manual guide 24*a* is located to allow for the manual insertion of paper, the machine is operable in both the manual feed mode and the automatic feed mode using the cassette 22. Under this condition, the $P_1$ flickers to attract the attention of the operator.

At this time, if the automatic feed mode has been selected by the select key 41, the manual feed mode or the automatic feed mode can only be determined by the position of the manual guide 24*a*. Accordingly, it is turned on or off according to the position of the manual guide 24*a*. In this case, the cassette 22 is not selected and therefore is not used.

Further, if the manual feed cassette 21*a* is not attached to the machine, it is apparent that the copy machine is allowed to operate only in the manual feed mode or the automatic feed mode. Therefore, the pattern $P_1$ is left off.

The patterns $P_2$–$P_5$ are used together with the display 42, and each provide a pattern corresponding to each paper size displayed 42 such as A3, B4, A4, or B5, thereby indicating the size of the paper in each cassette 22 and 22*a*.

The patterns $P_{11}$ and $P_{12}$ either light up or turn off, or flicker to indicate conditions shown in Table 2.

TABLE 2

| Cassette as set | Cassette contents | Display state |
|---|---|---|
| Cassette 22 | Cassette 22 is empty | $P_{10}$ . . . Flickers<br>$P_{11}$ . . . OFF<br>$P_{12}$ . . . Flickers |
| Cassettes 22 and 22a | Cassette 22 is empty. | $P_{10}$ . . . Flickers<br>$P_{11}$ . . . ON<br>$P_{12}$ . . . Flickers |
| Same as above | Cassette 22a is empty. | $P_{10}$ . . . Flickers<br>$P_{11}$ . . . Flickers<br>$P_{12}$ . . . ON |
| Cassette 22a | Cassette 22a is empty. | $P_{10}$ . . . Flickers<br>$P_{11}$ . . . Flickers<br>$P_{12}$ . . . OFF |

From the combined displays of the patterns $P_{10}$–$P_{12}$, an operator can exactly know the which cassette is selected, and if the cassette or cassettes is empty or not.

When jamming is indicated by the patterns $P_{14}$ only or $P_{14}$ and $P_{15}$ occurs, and if only the cassette 22 is set, the patterns $P_{11}$ and $P_{12}$ are both off. If the cassettes 22 and 22*a* are both attached, the pattern representing a cassette selected by the select key 41 flickers, and the pattern not selected is turned on. In this way, an operator can quickly know which cassette caused the jam.

Usually, the pattern $P_{27}$ is on in the automatic feed mode. One of the patterns $P_{28}$–$P_{34}$ is displayed according to the number of operations of, or the duration of the operation of each key 45 and 46. When the density setting key 45 is pushed, those patterns are sequentially displayed from the pattern $P_{34}$ to the pattern $P_{28}$. On the other hand, when the key 46 is pushed, the patterns are sequentially displayed from the pattern $P_{28}$ to the pattern $P_{34}$. In this way, an exposure amount manually set is visually displayed.

When any one of the patterns $P_9$, $P_{10}$, and $P_{13}$ to $P_{18}$ is displayed, something is wrong with the copy machine. Therefore, the patterns $P_{22}$ and $P_{19}$ are alternately turned on to call operator's attention to open the upper unit 1*a* and remove the jammed paper, for example.

[Operation of Copy Machine]

The operation of the copy machine thus structured will be described.

For copying documents using a copy machine, the cover 4 is opened, a document to be copied is set on the table 3, and the cover 4 is closed again.

Desired copying conditions, such as magnification, exposure mode (density), selection of the cassette, and the number of copies, are set by appropriately operating the control panel 34.

After the power is on, the copy machine is initially set to have an equal magnification mode (when the magnification setting key marked 100% is pushed), an automatic exposure mode (when the AE mode select key 44 is operated), and a selected cassette 22 (when the select key 41 is operated). This initial state of the copy machine will be referred to as the prior mode. The prior mode can be set by operating the control panel 34. If the copy machine is not used for a predetermined period of time, the copy machine automatically returns to the prior mode.

Then, the desired number of copies is set by the ten key 36. In turn, the print display 38 displays th number of copies.

After the number of copies is set, the print key 35 is operated to start the copying operation.

Upon operation of the print key 35, the photosensitive drum 2 starts its rotation, and at the same time the image-forming means starts its operation.

The first and the second carriages 8 and 15 move at a speed ratio of 1:½ to the right in FIG. 1. The surface of the photosensitive drum 2 is slit-exposed with the light containing the information of an image of the document. With this slit exposure, a latent image is formed on the surface of the photosensitive drum 2. The latent image formed is developed by the developer 19. By operating the select key 41, the paper P is picked up from the cassette 22 or 22*a* and is fed to the image-forming means. If necessary, paper P may manually be fed. More specifically, the feed roller 23 or the feed roller 23*a* associated with the cassette 22 or 22*a* as selected by the select key 41, is rotated to feed the paper.

The paper P is temporarily stopped at the aligning roller 26. Then, it is aligned with the leading position of the toner image formed on the surface of the photosensitive drum 2, and is fed toward the transfer unit 27.

The transfer unit 27 electrostatically transfers the latent image onto the paper P. At this time, paper P is electrostatically stuck to the surface of the photosensitive drum 2. The separator 28 separates this paper P from the drum surface. The separated paper P bearing the toner image on the surface thereof is transferred to the fixing unit 31 by the transfer unit 30. In the fixing unit 31, the toner image is fixed on the paper P, and then the paper P with the fixed toner image is discharged to the tray 33 by the exit roller 32.

The photosensitive drum 2, after being subjected to the transfer process, is cleaned by the cleaning unit 29, to remove the toner left on the surface thereof. Finally, the photosensitive drum 2 is illuminated by the quenching lamp 17, to quench the charges on the drum surface. At this point, the photosensitive drum 2 enters the next image-forming cycle.

The desired number of copies is obtained by repeating the above process a corresponding number of times.

Sensors $D_1$ and $D_2$ as a sensing means are provided along the transfer path of paper P in FIG. 1. More specifically, the sensor $D_1$ is located upstream of the aligning roller 26. The sensor $D_1$ senses at the sensor $D_1$ position and at a predetermined time the presence or absence of the paper P fed from the cassette 22 by the feed roller 23, the paper P from the manual feed port 24, or the paper P fed from the manual guide 24*a* or cassette 22*a*.

The sensor $D_2$ senses at the position and at a predetermined timing the presence or absence of the paper P that has passed the transfer unit 30 and the fixing unit 31.

Each of the sensors $D_1$ and $D_2$ may be a microswitch, a photosensor, a combination of a magnet switch and an actuator, a ultrasonic wave sensor, or the like.

The sensor $D_1$ senses paper feed errors and jamming at the time of paper feeding, and jamming of the manually fed paper. More specifically, if it fails to sense the paper P after a predetermined time from the rotation start signal (paper feed signal), the sensor $D_1$ decides that a paper feeding error has occurred. If the sensor $D_1$ still senses the presence of the paper P after a predetermined time since sensing the paper P, it decides that jamming has occurred in the feeder 21.

The sensor $D_2$ senses jamming of the paper in the path from the aligning roller 26 to the exit roller 32. If the sensor $D_2$ fails to sense the paper P after a predetermined time since the sensor D1 has sensed the paper P, it decides that jamming has occurred. In most cases, this is caused when the separator 28 inperfectly separates the paper P from the photosensitive drum 2 (separation error), and when jamming occurs in the fixing unit 31.

When a paper feeding error or jamming occurs, the patterns $P_{13}$, $P_{14}$ and $P_{15}$ of the display panel 43 are energized.

[Control Section]

The control section will be described mainly relating to the LC display 43. A configuration of the control circuit for controlling the operation of the copy machine is illustrated in block form in FIG. 4.

The main control section 47, based on a microprocessor, contains a memory for storing all of the control programs which control the operations of the copy machine. The main control section 47 is coupled with the sensors $D_1$ and $D_2$, the sensing switches $D_3$ and $D_4$, and further to the various types of the keys 35–37, and 40–46, and the print display 38. Upon receipt of the signals of these sensors and keys, the main control section 47 produces the control signals necessary for controlling the operations and displays of the copy machine.

The control section 47 converts the signal representing the state of each portion into a data signal of 32 bits, and outputs it through an output terminal OD. Output terminals OL and OC of the main control section 47 provide a latch signal and a clock signal. The output terminals OD, OL and OC are respectively coupled with input terminals ID, IL and IC of a liquid crystal (LC) driver 48. Output the data signal is performed in synchronism with the clock signal. An oscillator 49 supplies a drive pulse to the LC driver 48. To be more specific, the oscillator 49 applies a drive pulse A to an input terminal $DP_1$ of the LC driver 48. The frequency of the drive pulse A is most suitable for driving the LC display 43. The drive pulse A is phase-inverted by an inverter circuit 50, and is applied as a drive pulse B to an input terminal $DP_2$ of the LC driver 48.

Output terminals $O_1$–$O_{32}$ of the LC driver 48 respectively provide segment drive signals according to the contents of the data signal applied to the input terminal ID. These drive signals are correspondingly applied to display segments $S_1$–$S_{32}$ of the LC display 43. The drive pulse B is applied to a common electrode 51 provided opposite the segments $S_1$–$S_{32}$.

The segment electrodes $S_1$–$S_{32}$ respectively correspond to the patterns $P_1$–$P_{24}$, and $P_{26}$–$P_{34}$, as shown in Table 3. As seen from Table 3, of the segments in FIG. 4, only the segment $S_{29}$ shown in FIG. 4 is connected to both the patterns $P_{19}$ and $P_{20}$ shown in FIG. 3.

TABLE 3

| Segment (FIG. 4) | Pattern (FIG. 3) | Segment (FIG. 4) | Pattern (FIG. 3) |
|---|---|---|---|
| $S_1$ | $P_7$ | $S_{17}$ | $P_9$ |
| $S_2$ | $P_8$ | $S_{18}$ | $P_{18}$ |
| $S_3$ | $P_1$ | $S_{19}$ | $P_{26}$ |
| $S_4$ | $P_2$ | $S_{20}$ | $P_{27}$ |
| $S_5$ | $P_3$ | $S_{21}$ | $P_{28}$ |
| $S_6$ | $P_4$ | $S_{22}$ | $P_{29}$ |
| $S_7$ | $P_5$ | $S_{23}$ | $P_{30}$ |
| $S_8$ | $P_6$ | $S_{24}$ | $P_{31}$ |
| $S_9$ | $P_{10}$ | $S_{25}$ | $P_{32}$ |
| $S_{10}$ | $P_{11}$ | $S_{26}$ | $P_{33}$ |
| $S_{11}$ | $P_{12}$ | $S_{27}$ | $P_{34}$ |
| $S_{12}$ | $P_{13}$ | $S_{28}$ | $P_{21}$ |
| $S_{13}$ | $P_{14}$ | $S_{29}$ | $P_{19}$, $P_{20}$ |
| $S_{14}$ | $P_{15}$ | $S_{30}$ | $P_{24}$ |
| $S_{15}$ | $P_{16}$ | $S_{31}$ | $P_{23}$ |

TABLE 3-continued

| Segment (FIG. 4) | Pattern (FIG. 3) | Segment (FIG. 4) | Pattern (FIG. 3) |
|---|---|---|---|
| $S_{16}$ | $P_{17}$ | $S_{32}$ | $P_{22}$ |

Figure 5:
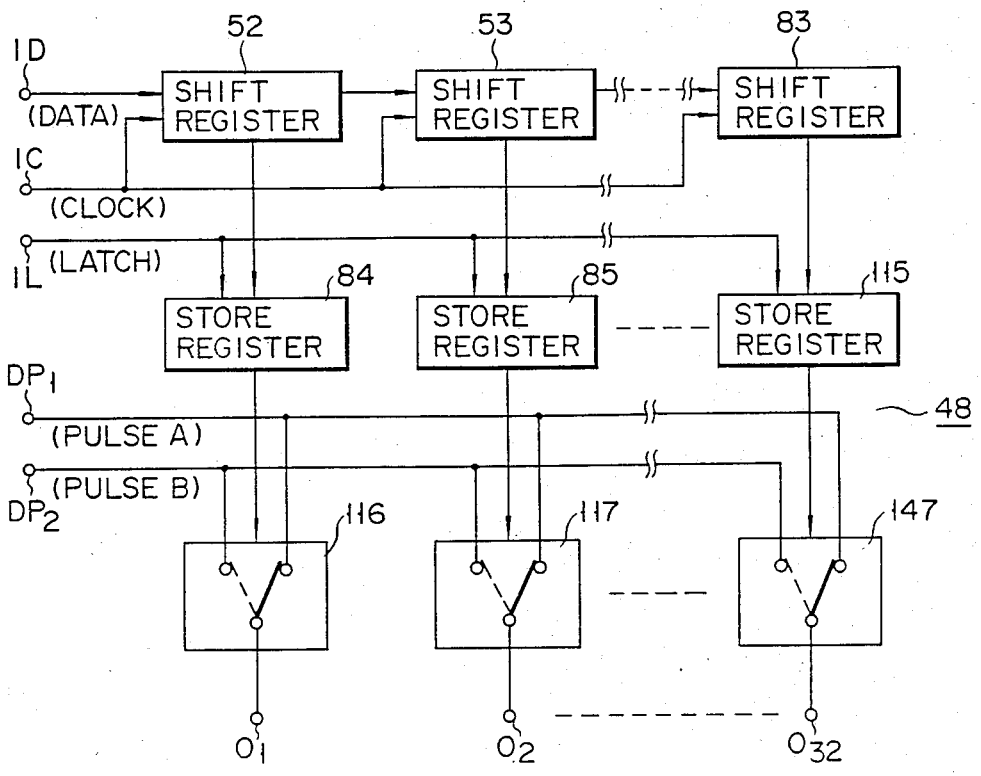
FIG. 5 is a block diagram illustrating a major part of the control circuit of FIG. 4.

Turning now to FIG. 5, there is shown the details of the LC driver 48. As shown, 32 shift registers 52–83 are connected in a cascade fashion. A data signal from the input terminal ID is applied to the first stage shift register 52. A clock signal from the input terminal IC is input to those shift registers 52–83. The data signal from the input terminal ID is sequentially transferred through the shift registers 52–83 in synchronism with the clock signal from the input terminal IC. The shift registers 52–83 are directly coupled with 32 store registers 84–115. The store registers 84–115 store the contents of the corresponding shift registers 52–83, in response to a latch signal coming through the input terminal IL. The store registers 84–115 respectively control switches 116–147 according to the contents stored therein. Through the switching operation of the switches thus controlled, the drive pulse A or B is selectively applied to the output terminals $O_1$–$O_{32}$. For example, when the store register stores "1," the drive pulse A is applied to the corresponding output terminal. When it stores "0," the drive pulse B is applied to the corresponding output terminal.

[Display Operation]

The display operation of the copy machine will be described referring to FIGS. 6–58.

Timing charts illustrating timings among data signals, clock signals and latch signals when the main control section 47 sends data to the LC driver 48, are illustrated in FIGS. 6, 8, 10, 12, 14, 16, 25, 27, 29, 35, 37, 39, 45, 47, 52 and 54. Waveforms of voltages applied to the LC display 43 are illustrated in FIGS. 7, 9, 11, 13, 15, 17, 26, 28, 30, 36, 38, 40, 46, 48, 53 and 55. Examples (C–R) of figures displayed by the LC display 43 are illustrated in FIGS. 18–23, 31–33, 41–43, 49, 50, 56 and 57. Timing charts illustrating switching timings of displayed figures are shown in FIGS. 24, 34, 44, 51 and 58.

In the description to follow, it is assumed that paper of A3 size is stored in the cassette 22*a* and paper of B4 size is stored in the cassette 22. As recalled, the copy machine indicates the storage of the A3 paper while displaying the pattern $P_2$ in FIG. 3 and the paper size through the paper size display 42 in FIG. 2. Similarly, the storage of the B4 paper is indicated with the display of the pattern $P_3$ in FIG. 3 and with a display of the paper size by the paper size display 42 in FIG. 2.

The display operation will be given in the order of "Display of Exposure Density," "Display of Manual Paper Feed," "Display of Jamming" and "Display of Empty."

(1) Display of Exposure Density

Figure 24:
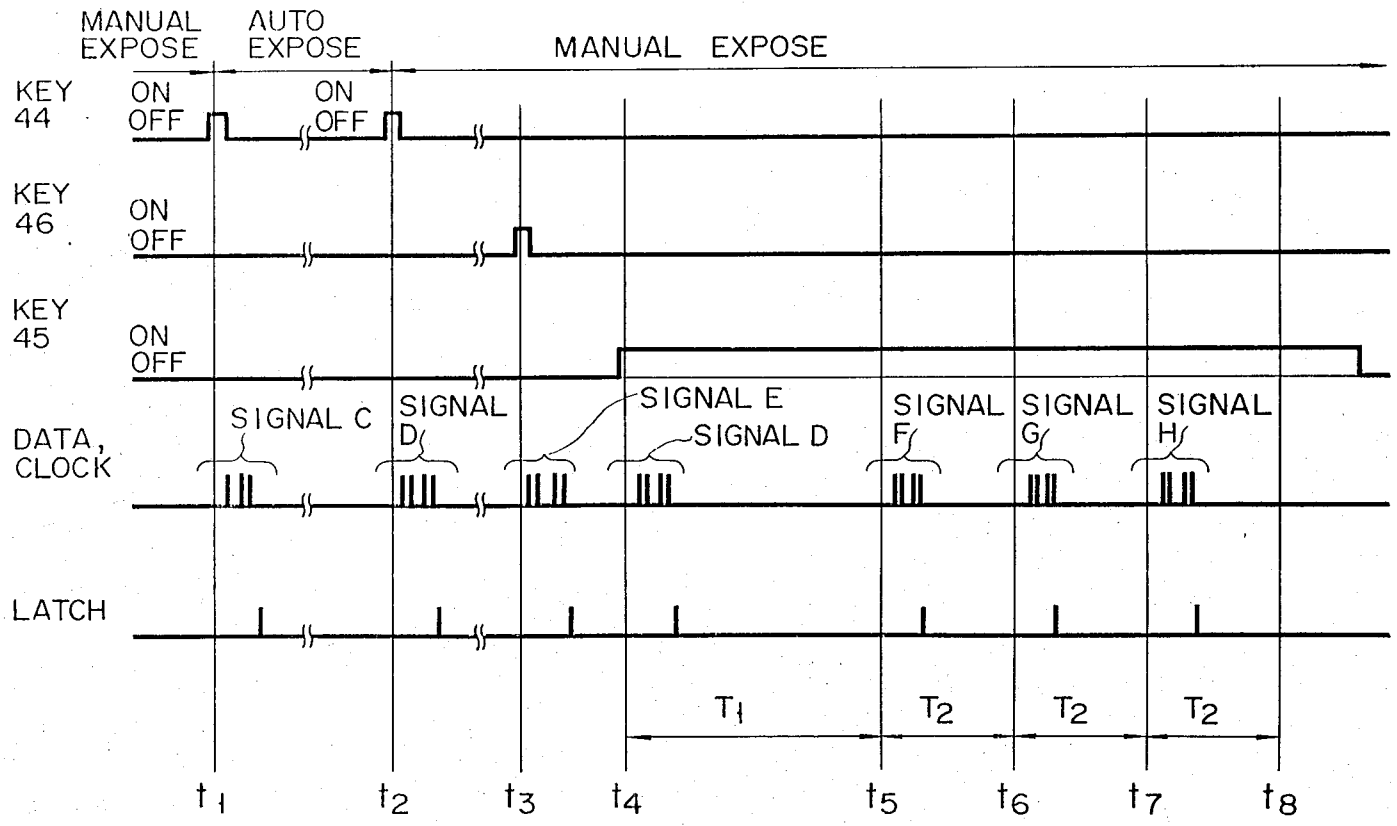
FIG. 24 shows a timing chart useful in explaining the switching operation of the displayed figures.

The AE mode select key 44 is first operated, and then a signal generated by the key operation enters the main control section 47 ($t_1$ in FIG. 24). The main control section 47 switches the exposure mode from the manual exposure mode to the automatic exposure mode. The main control section 47 produces at the terminal OD a data signal indicating that the cassette 22*a* is selected by the select key 41 and that the copy machine is ready for copying operation. The data signal contains data of 32 bits (10010000000000000010000000000000), as shown in FIG. 6(*a*). In this case, the main control section 47 produces a clock signal at the terminal OC, as shown in FIG. 6(*b*). In synchronism with the clock signal, the data signal is produced. The combination of the data signal and the clock signal will be called merely signal C. Thus, the data is sequentially output up to 32 bits in synchronism with the clock signal. As the 32nd bit is output, the main control section 47 produces at the terminal OL a latch signal, as shown in FIG. 6(*c*).

In the LC driver 48, the data signal from the main control section 47 is sequentially shifted through the shift registers 52–83, in synchronism with the clock signal. Further, the data signal is stored into the store registers 84–115 at the time of inputting the latch signal at the terminal IL.

The contents of the store registers 84–115 are "0" or "1" according to the data signal applied. The switches 116 to 147 are driven according to the contents of the store registers 84–115. The terminals $O_1$, $O_4$ and $O_{19}$, which are connected to the store registers containing "1," provide the drive pulses A, respectively. The drive pulses A are applied as drive signals to the segments $S_1$, $S_4$ and $S_{19}$ of the LC display 43.

The output terminals $O_2$, $O_3$, $O_5$–$O_{18}$, $O_{20}$–$O_{32}$ connected to the store registers containing "0" provide drive pulses B. The drive pulses B are applied as drive signals to the segments $S_2$, $S_3$, $S_5$–$S_{18}$, $S_{20}$–$S_{32}$.

Figure 7:
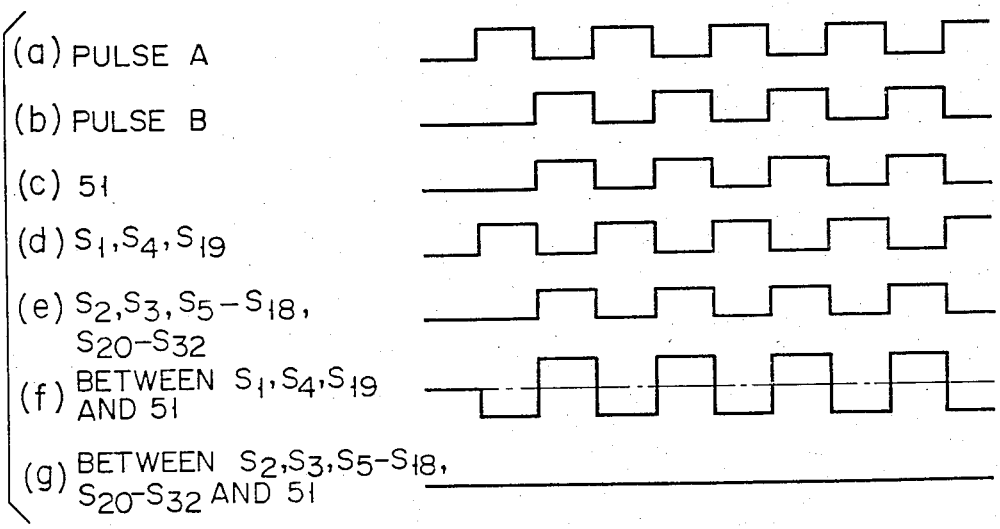

As shown in (a)–(e) of FIG. 7, the drive pulse A applied to the segments $S_1$, $S_4$, and $S_{19}$ is out of phase with respect to the drive pulse B applied to the common electrode 51. The drive pulse B applied to the segments $S_2$, $S_3$, $S_5$–$S_{18}$, and $S_{20}$–$S_{32}$, is in phase with respect to the drive pulse B applied to the common electrode 51. Therefore, a potential difference is produced between the common electrode 51 and the segments $S_1$, $S_4$ and $S_{19}$, as shown in (f) of FIG. 7. This indicates that an AC voltage is equivalently applied between them. As a result, the segments $S_1$, $S_4$ and $S_{19}$ are driven, and the patterns $P_7$, $P_2$ and $P_{26}$ shown in FIG. 3 are lit. Between the segments $S_2$, $S_3$, $S_5$–$S_{18}$, and $S_{20}$–$S_{32}$ and the common electrode 51, there is produced no potential difference, as shown in (g) of FIG. 7. Therefore, those segments are not driven and the corresponding patterns are also not displayed.

Figure 18:
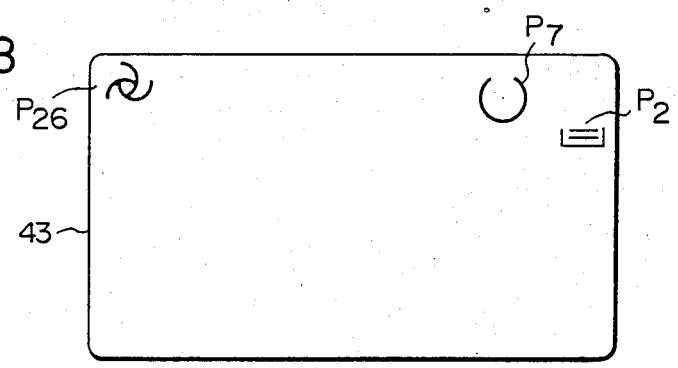
FIGS. 18–23 are plan views illustrating figures displayed by the display panel.

In this way, as shown in FIG. 18 (Example C), the LC display 43 displays that the cassette storing A3 paper and the automatic exposure mode as well are selected, and the copy machine is ready for copy.

Then, the AE mode select key 44 is operated again. The main control section 47 detects this at time $t_2$ in FIG. 24, and selects the automatic exposure mode or the manual exposure mode. Then, it produces a data signal, e.g. the data of (10010000000000000001000100000000), in synchronism with the clock signal. The combination of the data signal and the clock signal will be called simply a signal D. Following the data, a latch signal is produced.

As a result, "0" or "1" is stored in the store registers 84–115 according to the data applied. The output terminals $O_1$, $O_4$, $O_{20}$, $O_{24}$ associated with the store registers containing "1" provide the drive pulses A, respectively. The output terminals $O_2$, $O_3$, $O_5$–$O_{19}$, $O_{21}$–$O_{23}$, $O_{25}$–$O_{32}$ associated with the store registers containing "0" provide the drive pulses B, respectively.

Figure 9:
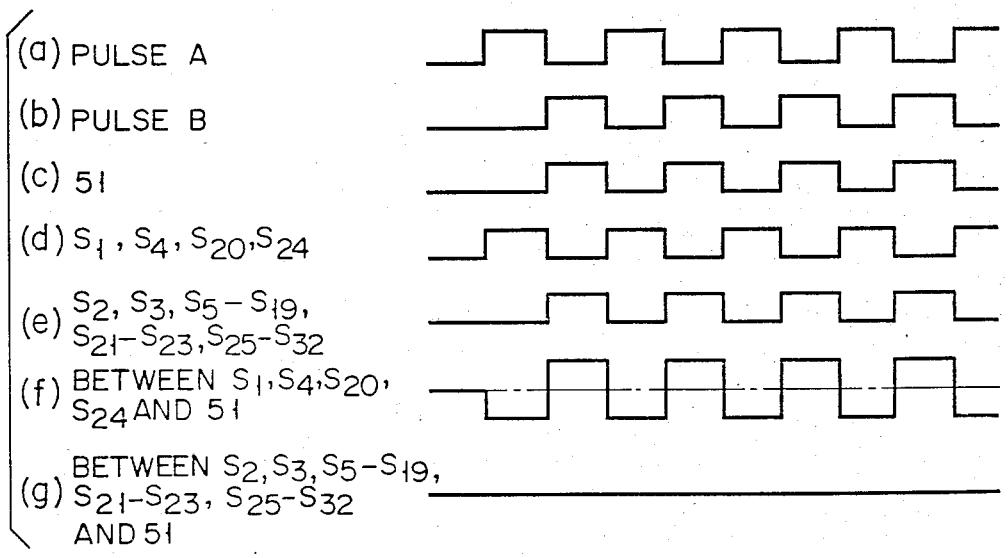

Waveforms of voltages applied to the segments are as shown in FIG. 9. Only the segments $S_1$, $S_4$, $S_{20}$ and $S_{24}$ having a potential difference against the common electrode 51, are driven to visualize the patterns $P_7$, $P_2$, $P_{27}$, and $P_{31}$. The display is illustrated as Example D in FIG.

19. When the exposure mode is switched from the automatic exposure mode to the manual exposure mode, the pattern $P_{31}$ is displayed like Example D, and a medium density is set as a default value.

Figure 10:
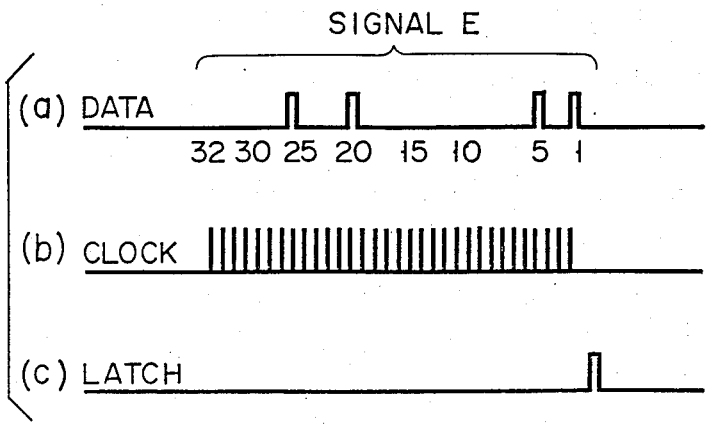

Under this condition, if the key 46 is pushed one time at $t_3$ in FIG. 24, the main control section 47 produces a signal for making the exposure density high one step, and produces a data signal E as shown in (a) of FIG. 10. For increasing the exposure density, the voltage applied to the exposure lamp 5 is dropped to reduce the amount of light therefrom to a predetermined level.

Figure 11:
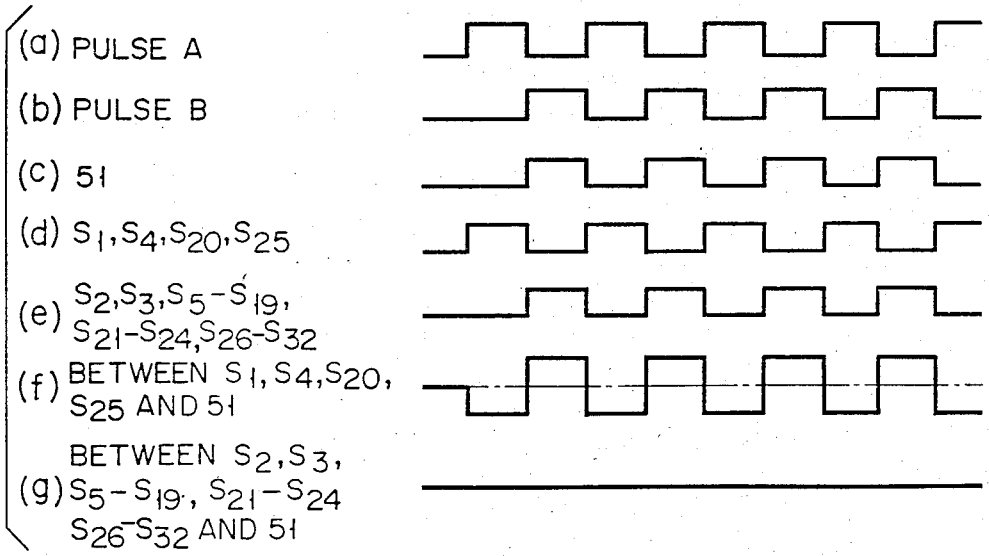
Figure 20:
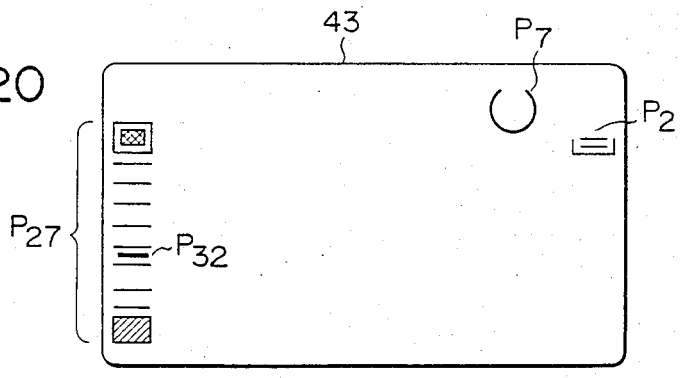

As a result, as in the previous case, only the segments $S_1$, $S_4$, $S_{20}$ and $S_{25}$ are driven, as shown in FIG. 11, and the display in this case is given as Example E in FIG. 20. After seeing this, an operator can know that the density is increased by one step.

Then, if the key 45 is pushed at time t4 of FIG. 24, the main control section 47 decreases the density by one step, and at the same time produces the signal D and the latch signal. The result is the display of Example D of FIG. 9 telling that the density is medium. Also at time $t_5$ (after time $T_1$ from time $t_4$), if the key 45 is continuously pushed, as shown in FIG. 24, the main control section 47 decreases the density further by one step.

Figure 12:
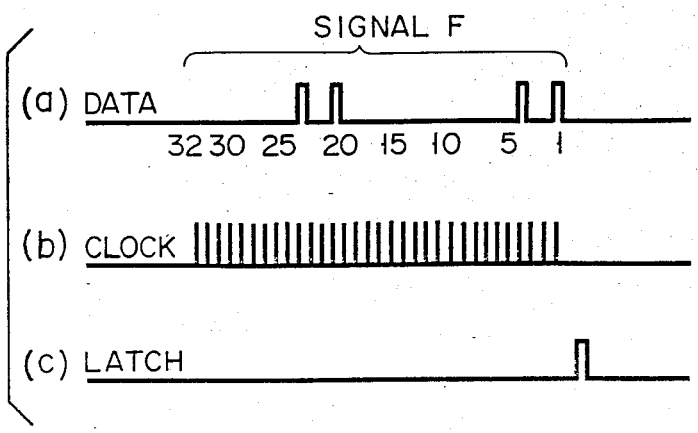

Simultaneously, it produces data (1001000000000000000001001000000000) in synchronism with the clock signal in FIG. 12. The combination of the data and the clock signal will be called signal E.

Figure 21:
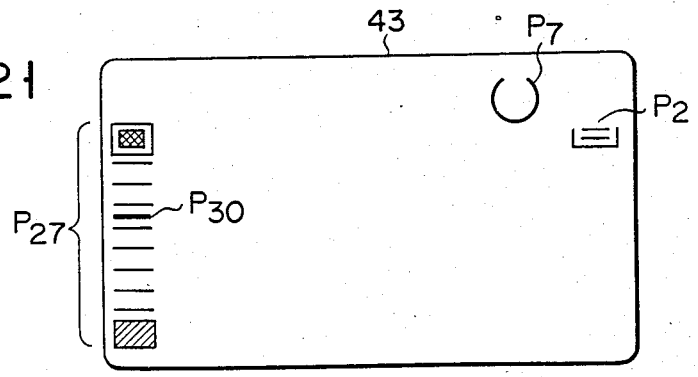

Through this operation, Example F of FIG. 21 is given as in the above case. Example F indicates that the density is decreased further by one step.

Figure 14:
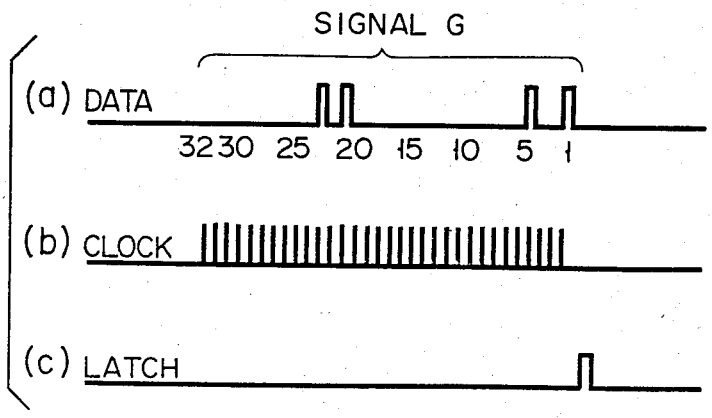

If the key 45 is still pushed at time t6 after time $T_2$ from time $t_5$, as shown in FIG. 24, the main control section 47 decreases the exposure density one more step, and at the same time produces signal G of FIG. 14 (the combination of the data signal and the clock signal), and a latch signal. The result is to provide the display of Example G through an operation similar to that above.

The display shows that the density is decreased further one step.

Figure 16:
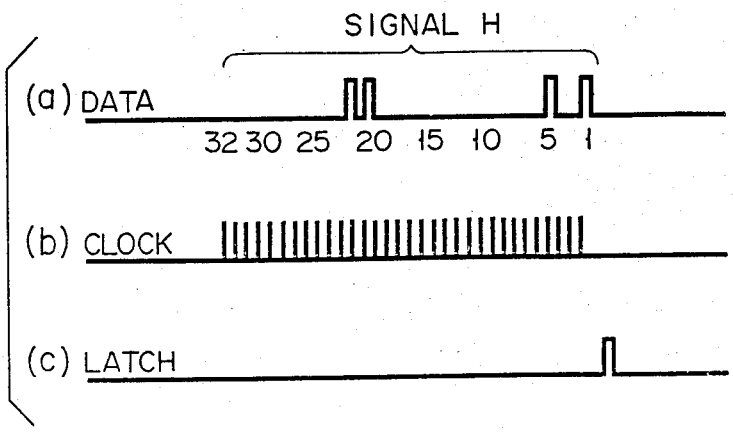
Figure 23:
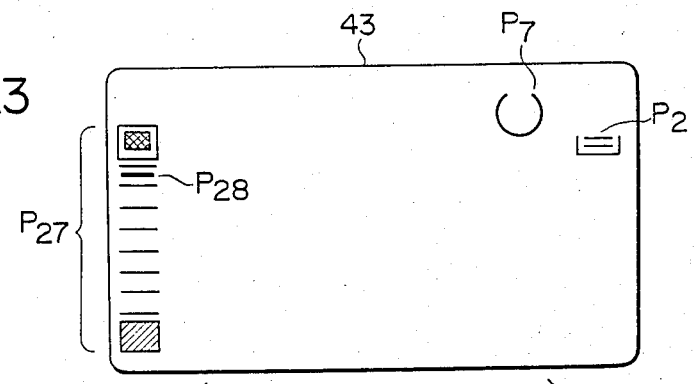

At time $t_7$ after $T_2$ from timing $t_6$, as shown in FIG. 24, if the key 45 is operated, the exposure density is decreased further by one step as in the above case, and produces signal H (the combination of a data signal and a clock signal) and a latch signal, as shown in FIG. 16. Then, Example H shown in FIG. 23 is displayed to indicate that the exposure density is at its thinnest (the exposure lamp 5 is in the brightest condition).

In FIG. 24, also at time $t_8$ after time $T_2$ from time $t_7$, if the key 45 is still pushed, the density is not decreased further or made thinner and the display is not changed, because the exposure density is now set at the thinnest density. These operations are carried out under control of the main control section 47.

Figure 6:
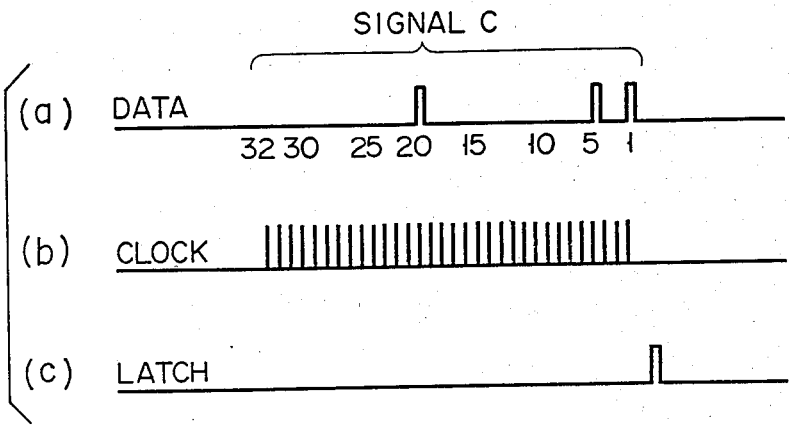
FIGS. 6 to 17 show timing charts useful in explaining the operation of the copy machine of FIG. 1.

In the above description, only the case Example C of FIGS. 6, 7 and 18 was detailed, but Examples D–H were briefed for simplicity. The description of Example C is correspondingly applied to the cases of FIGS. 8–17, and 19–23, and hence a description thereof will be omitted.

FIG. 24 illustrates timings of operations of the keys 44, 45 and 46, and of outputting of the signals C–H and a latch signal, when the automatic exposure mode is switched to the manual exposure mode, and the exposure density is changed in the automatic exposure mode.

It is believed, therefore, that the operation of the FIG. 24 case will easily be understood if the above description is referred to.

As seen from the foregoing, an operator, when seeing the displays as mentioned above, can easily and quickly know the present exposure mode, i.e. the automatic exposure mode or the manual exposure mode, and the present exposure density.

For the exposure mode switching, a single key, or the key 44, is used with repeat key action. This feature reduces the number of key switches as required. Further, since the LC display 43 displays the patterns specific to the respective modes, it can accurately be known what mode is now set up in the copy machine.

Further, the pattern 27 displays a change of the amount of light every time the key 45 or 46 is operated. In this way the exposure amount manually set is visually displayed.

(2) Display of Manual Paper Feed

The display operation when the manual uide **24*a* is moved to cause the copy machine to be in a manual feed mode, will be described referring to FIGS. 25–34**.

In the description to follow, the operations of the respective portions illustrated in FIGS. 4 and 5, will be not described in detail, because these are much the same as those as mentioned above. This will be applied to the description of the remaining display operations to be given later.

Figure 25:
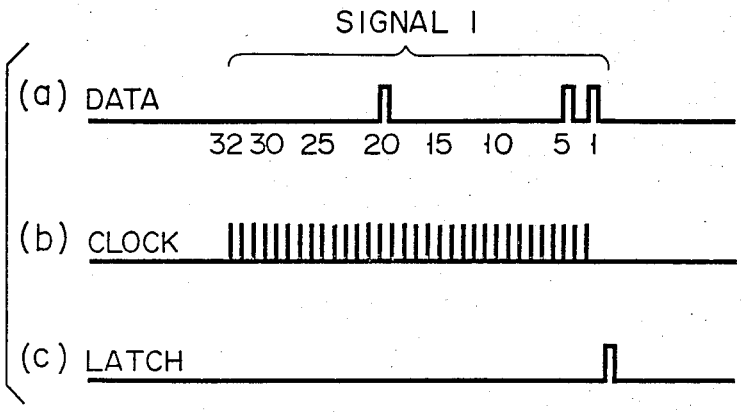
FIGS. 25–30 show timing charts useful in explaining the display operation of the copy machine of FIG. 1.
Figure 26:
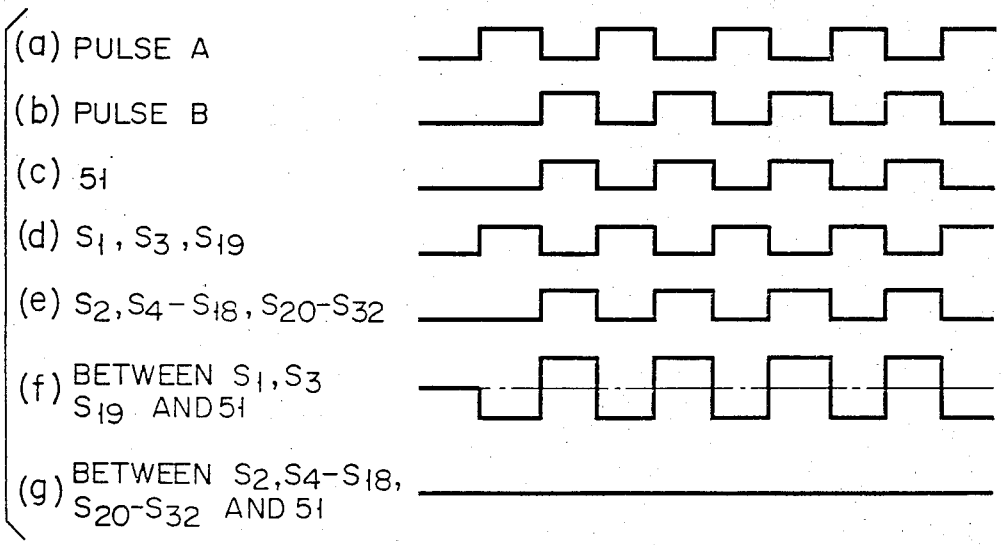

It is assumed that when the cassette **22*a* is selected, the copy machine is in the automatic exposure mode, and is ready for the copying operation. In this case, Example C as shown in FIG. 18 is displayed. Under this condition, if the manual guide 24*a* is set, the main control section 47 detects the setting of the manual guide 24*a*, and produces a data signal of data (1010000000000000000100000000000000) as shown in FIG. 25 and a clock signal. The combination of these signals will be called signal I. For this operation, reference is made to time $t_9$ in FIG. 34. As a result, voltage with a waveform as shown in FIG. 26 is applied to the respective segments. Then, the patterns $P_7$, $P_1$ and $P_{26}$ (FIG. 3) are displayed and Example I shown in FIG. 31** is given.

As shown, the pattern $P_2$ representing the size of the paper in the cassette **22*a* (FIG. 3**) goes out. In place of this pattern, the pattern $P_1$ is lit to indicate that the copy machine is in the manual feed mode.

Figure 27:
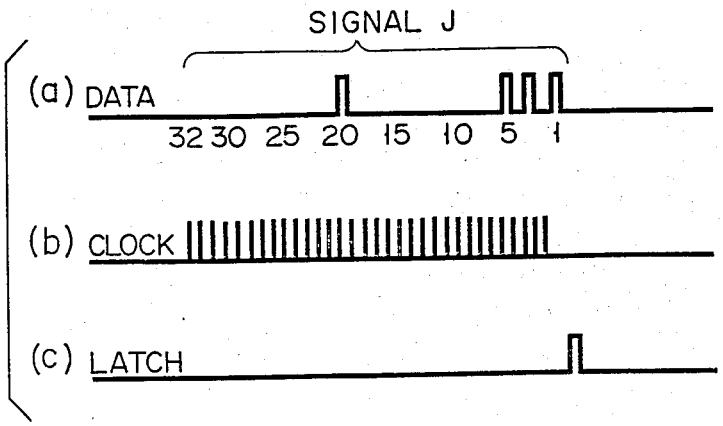
Figure 28:
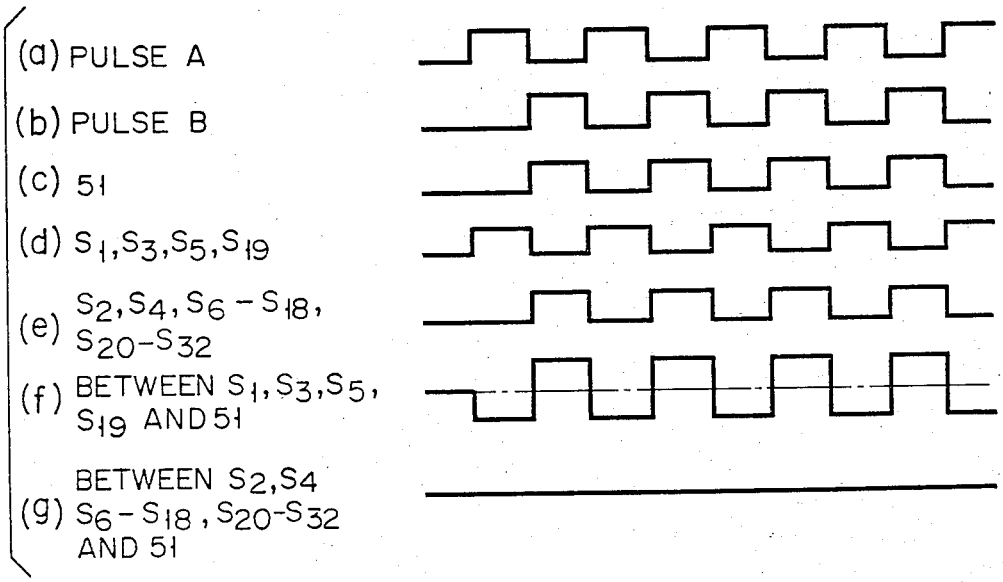
Figure 29:
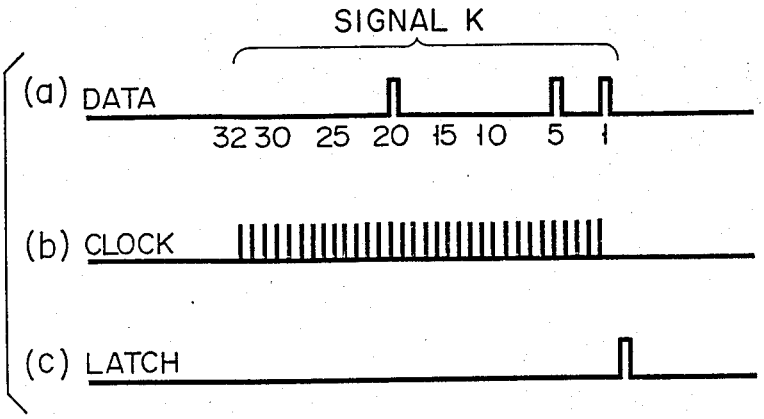
Figure 30:
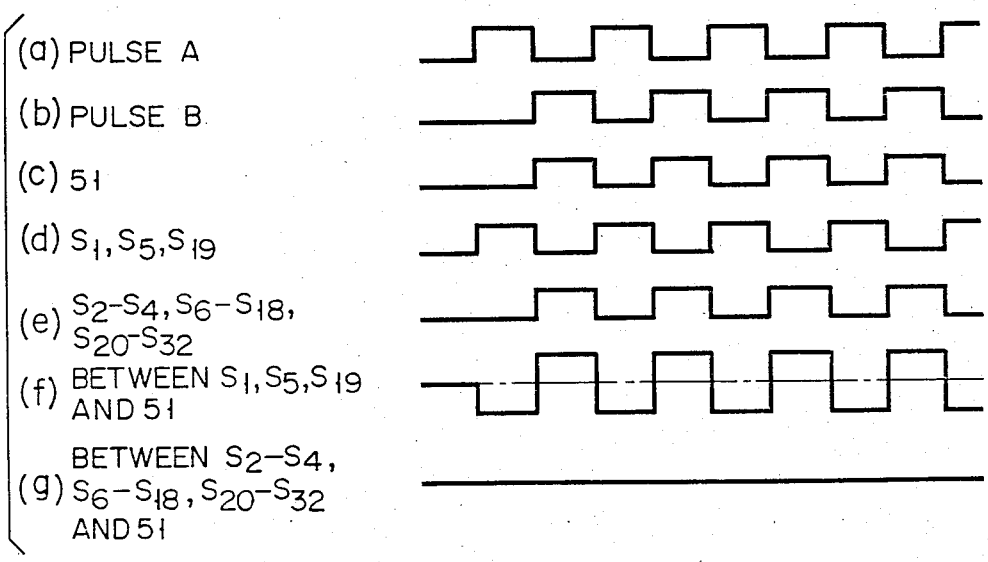
Figure 33:
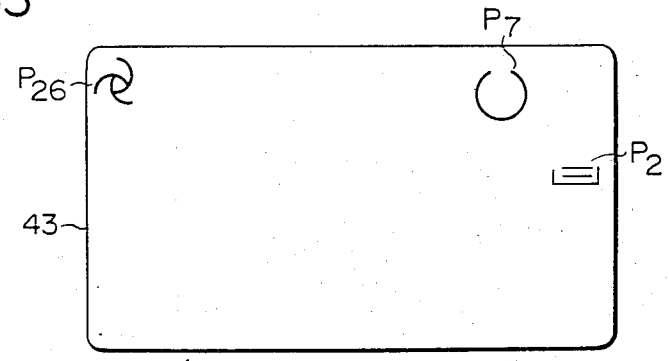
Figure 34:
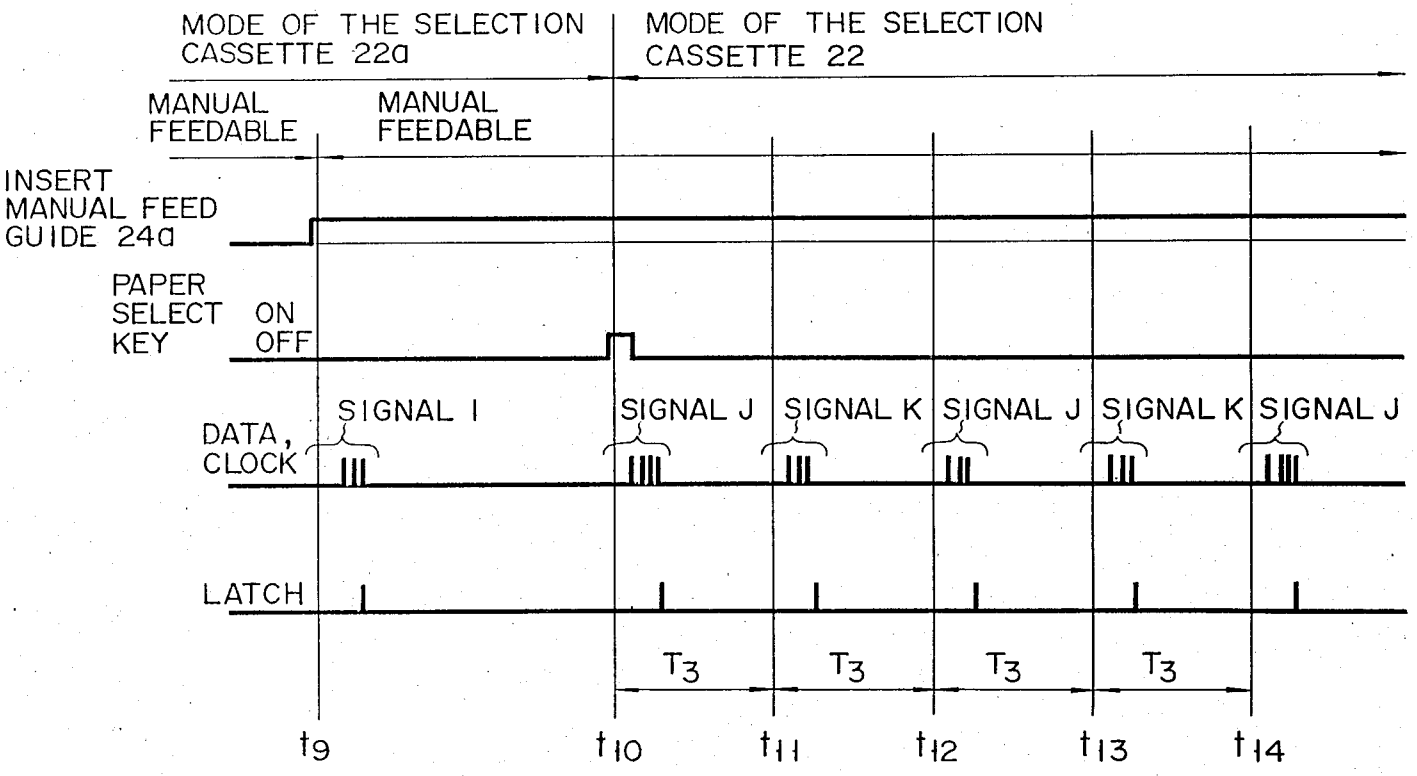
FIG. 34 shows a timing chart illustrating the switching operation of the displayed figures.

Under this condition, if the key 41 is operated, the main control section 47 produces a signal J as shown in FIG. 27 (time $t_{10}$ in FIG. 34). At time $t_{11}$ after $T_3$ from time $t_{10}$, a signal K as shown in FIG. 29 is produced by the main control section 47 (see FIG. 34). Further, time $T_3$ lapses, and the main control section 47 produces a signal J as shown in FIG. 27 (time $t_{12}$ in FIG. 34). Voltages applied to the respective segments are as shown in FIGS. 28 and 30. Then, Example J of FIG. 32 and Example K of FIG. 33 are alternately displayed every $T_3$.

In FIG. 3, the patterns $P_7$, $P_3$ and $P_{26}$ are always displayed, and only the pattern P1 is lit as it flickers.

In this way, the size of the paper in the cassette 22 is displayed, and it is indicated that the automatic paper feeding from the cassette 22 is allowed.

Accordingly, the display indicates that the manual paper feed using the manual guide **24*a* as well as the automatic paper feed from the cassette 22 is possible. Further, flickering of the pattern $P_1$ indicates that if the print key 35 is operated under such condition, the automatic paper feed will be carried out. If the manual paper feed is desired, paper is inserted along the manual guide 24a. Then, the copy machine copies the manually inserted paper. In this case, there is no need to operate the print key 35**.

The flickering of the pattern $P_1$ continues till the key 41 is operated to select the cassette 22a.

When the cassette 22a is selected, the manual feed mode or the automatic feed mode is selected through the slide operation of the manual guide 24a. Therefore, the flickering display is not performed.

The display as mentioned above can display whether or not the manual paper feed is allowed, whether or not the automatic paper feed from the cassette is allowed or not, and further if the automatic paper feed is allowed, the size of the paper in the cassette. Therefore, an operator can operate the copy machine without worrying about operation errors.

(3) Display of Jamming

The display operation when jamming occurs will be described referring to FIGS. 35–44.

In the description to follow, it is assumed that the cassette 22a is selected by the key 41.

In a copy ready mode, if the print key 35 is pushed, the main control section 47 detects it and causes the copy machine to carry out a copying operation under control of a predetermined program. At the same time, the main control section 47 produces a data signal indicating that the copy machine is under the copying operation, and a clock signal. The data signal consists of 32 bits formated as (00001000000000000010000000000000), for example. The combination of the data signal and the clock signal will be called a signal L. The main control section 47 further produces a latch signal as shown in (b) of FIG. 35. Through the operation similar to the above one, only the patterns $P_2$ and $P_{26}$ shown in FIG. 3 are driven to give Example L. For the display switching timing, see time $t_{15}$ in FIG. 44. For the voltages applied to the segments, see FIG. 36. For the display of Example L, see FIG. 41.

Figure 37:
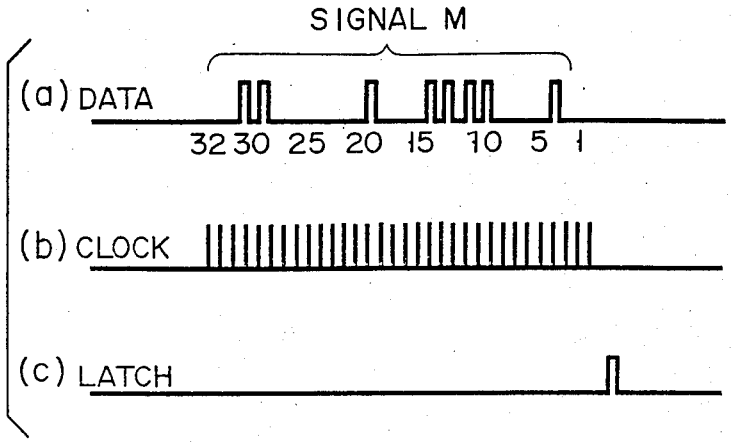

Under this condition, the sensors $D_1$ and $D_2$ sense jamming, for example, that the paper P being copied is stuck on the photosensitive drum 2. The main control section 47 recognizes the occurrence of jamming and interrupts the copying operation at time $t_{16}$ in FIG. 44, and produces a signal M (the combination of a data signal and a clock signal) as shown in FIG. 37, and a latch signal, which are in turn applied to the main control section 47.

Figure 38:
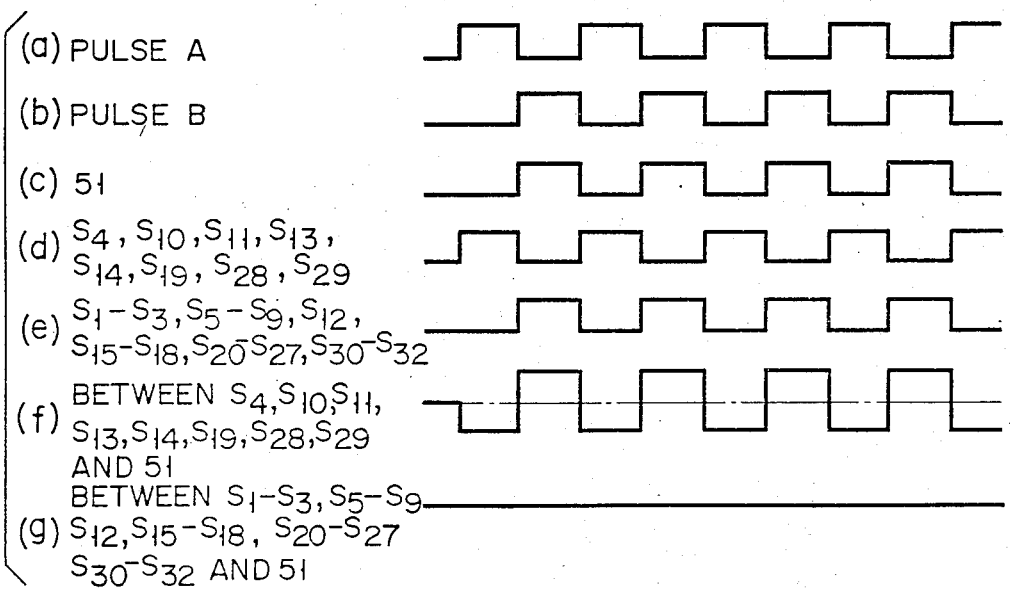
Figure 39:
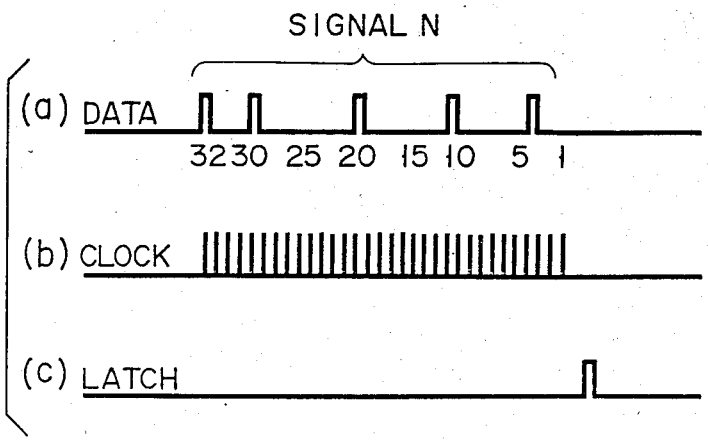
Figure 40:
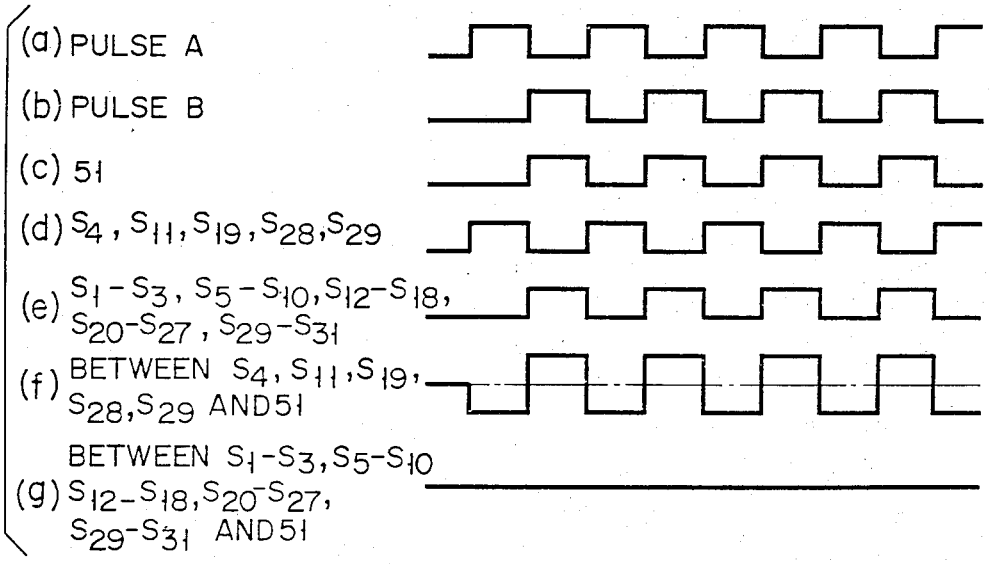

Then, the voltages applied to the respective segments are as shown in FIG. 38. After time $T_3$ from time $t_{16}$ (time $t_{17}$ in FIG. 44), a signal N (the combination of a data signal and a clock signal) as shown in FIG. 39, and a latch signal are produced from the main control section. As a result, voltages applied to the segments are as shown in FIG. 40. Subsequently, the signals M and N are alternately produced every $T_3$ at times $t_{18}$, $t_{19}$, $t_{20}$ . . . , as shown in a timing chart of FIG. 4.

Figure 42:
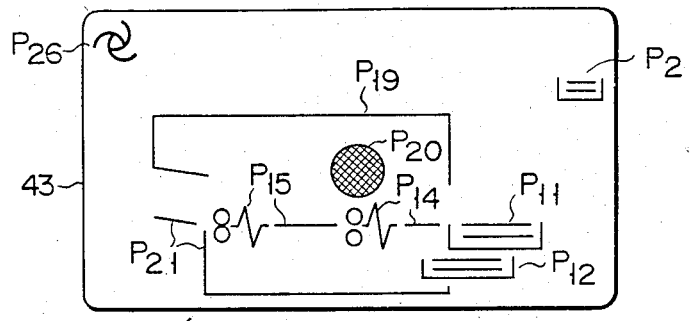
Figure 43:
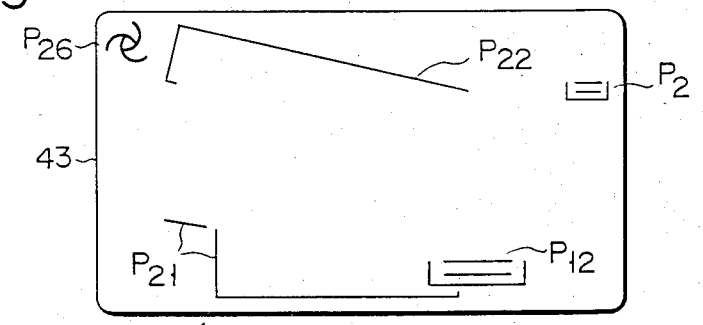

As a result, Example M of FIG. 42 and Example N of FIG. 43 are alternately displayed.

Specifically, the patterns $P_{22}$, $P_{19}$, $P_{20}$, $P_{14}$, $P_{11}$ and $P_{15}$ flicker, while the patterns $P_{26}$, $P_2$, $P_{21}$, and $P_{12}$ are continuously lit.

Seeing such a display, the operator can know that it is necessary to open the upper unit 1a and to remove the jammed paper, and that the jammed paper is fed from the cassette 22a.

Accordingly, when jamming occurs near the cassette 22a, an operator, after seeing the display, pulls out the cassette 22a and removes the jammed paper. In this way, the operator can quickly cope with jamming.

When the cassette 22 is selected by the select key 41, the continuously lighting patterns in the above case, viz. where the cassette 22a is selected, flicker, while the flickering patterns light continuously.

The display for jamming can teach an operator how to cope with jamming as it occurs (for example, open the upper unit 1a), and which cassette feeds the jammed paper.

On the basis of the display, an operator can quickly take the suitable measures for jamming.

(4) Display of Empty

Reference is made to FIGS. 45–51 for describing a case where the cassette 22a is empty when this cassette is selected and the copying operation is performed. Reference is made to FIGS. 52–58 describing a case where the cassette 22 is empty when the manual guide 24a is set and the cassette 22a is selected.

Figure 51:
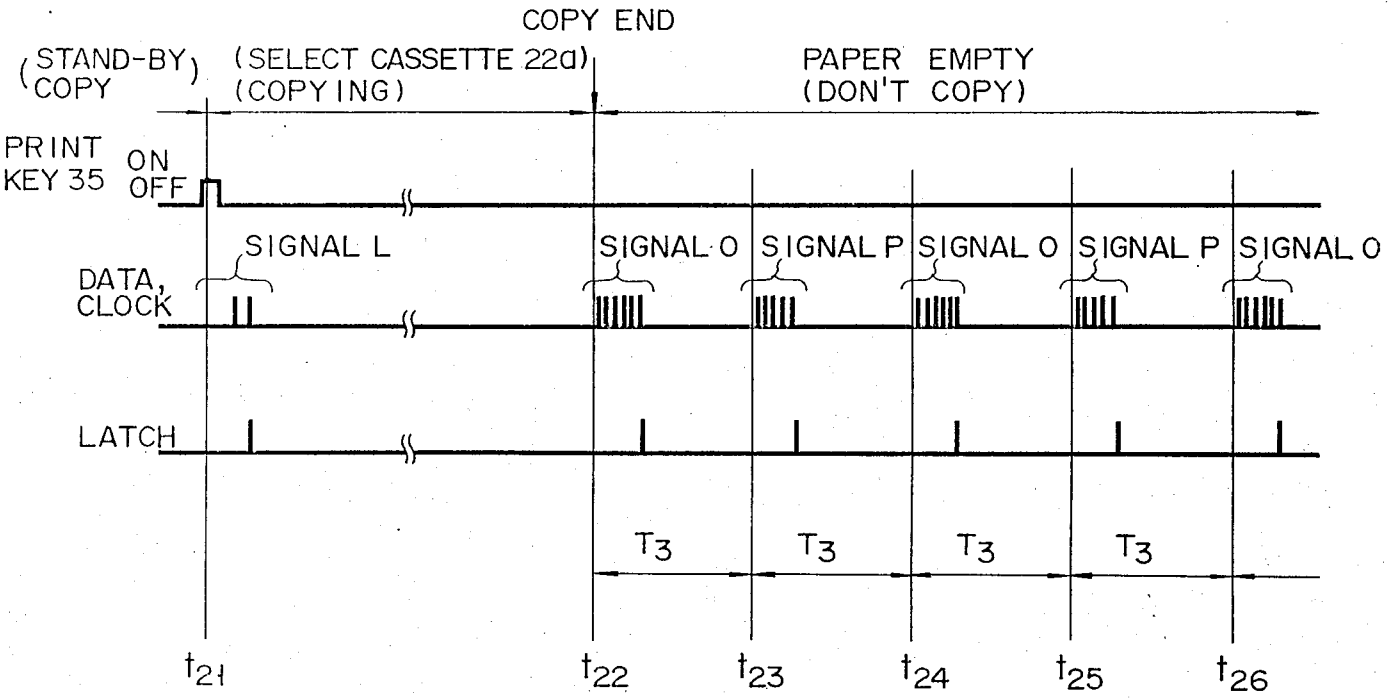
FIG. 51 shows a timing chart useful in explaining the switching operation of the displayed figure.

If the print key 35 is pushed in a copy ready mode, the copy machine starts copying ($t_{21}$ in FIG. 51).

Figure 45:
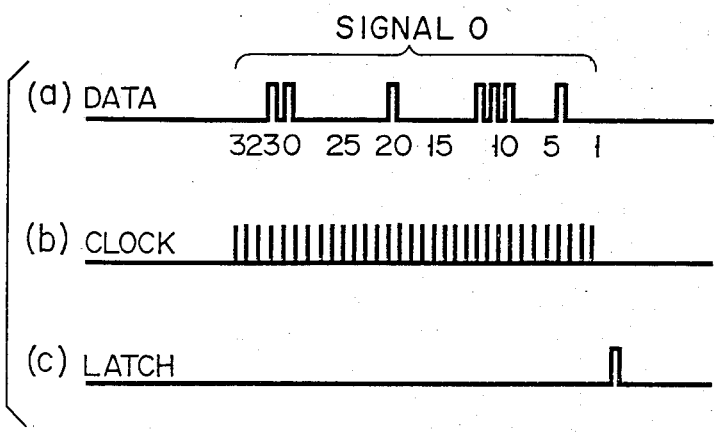
FIGS. 45–48 show timing charts useful in explaining the operation of the copy machine of FIG. 1.

Example L is given to indicate that the copying operation is going on. Under this condition, if the cassette is empty, the copy machine stops the copying operation ($t_{22}$ of FIG. 51) after copying the final paper, and at the same time produces a signal O (including a data signal and a clock signal) as shown in FIG. 45, and a latch signal. The empty state is sensed by empty sensing switches $D_3$ and $D_4$ such as microswitches or photosensors which are placed in the cassettes 22 and 22a.

Figure 47:
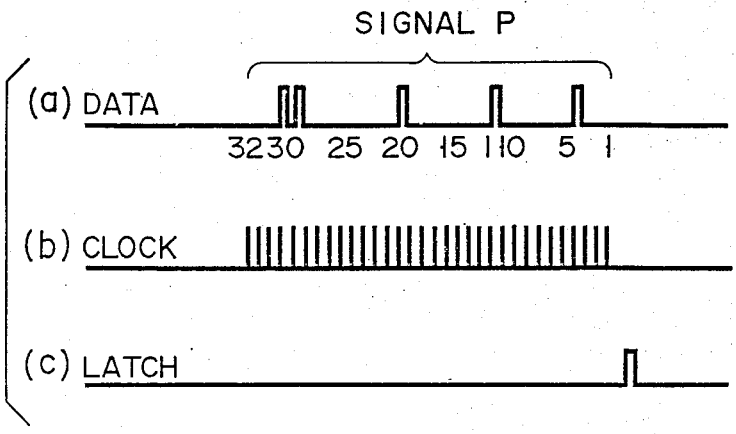

After time $T_3$ (time $t_{23}$ in FIG. 51), a signal P (including a data signal and a clock signal) as shown in FIG. 47 and a latch signal are produced.

Further, after time $T_3$ (time $t_{24}$ in FIG. 51), a signal O is produced.

Figure 46:
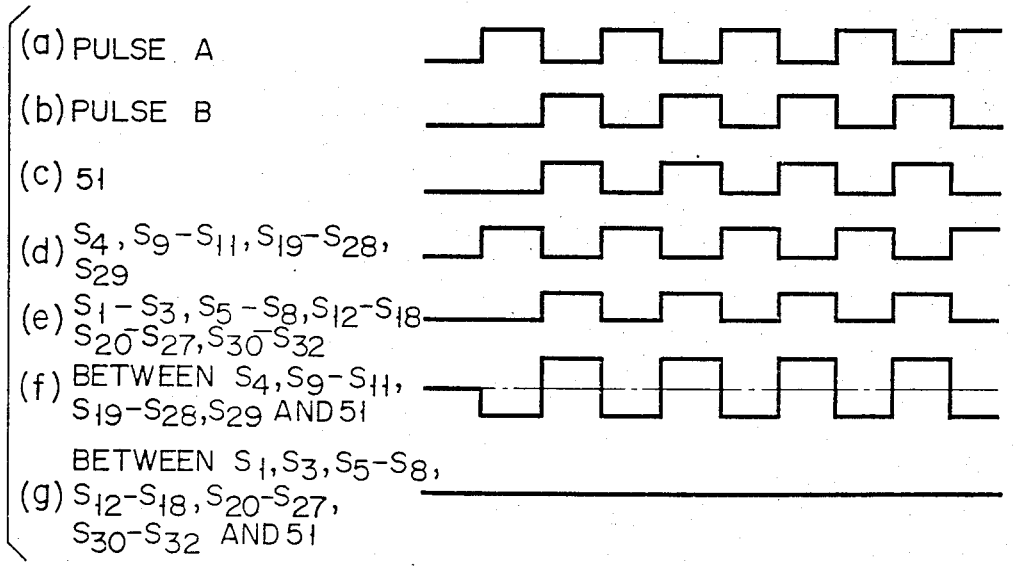
Figure 48:
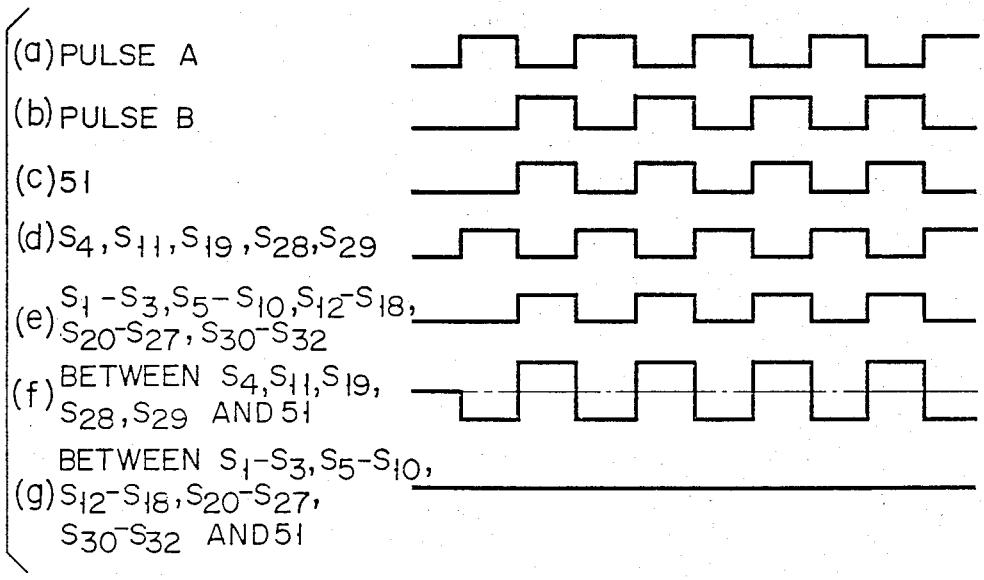

Subsequently, the signals O and P are alternately produced every $T_3$. The voltages applied to the respective segments are as shown in FIGS. 46 and 48.

Figure 49:
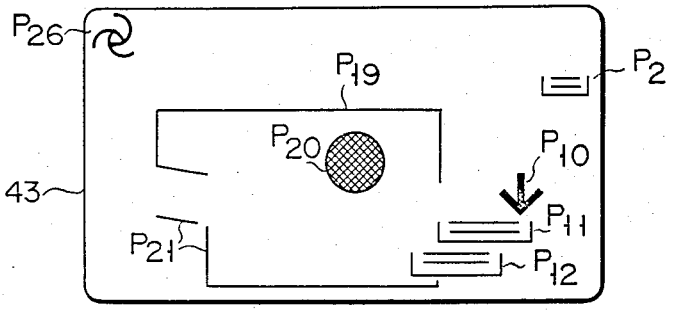
FIGS. 49 and 50 show figures displayed by the display panel of FIG. 3.
Figure 50:
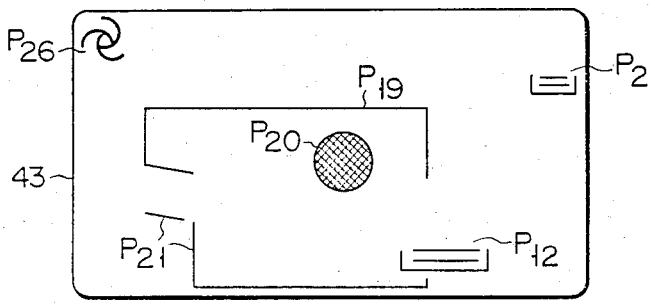

Therefore, the display pattern in this case is an alternate display of the Examples O and P as shown in FIGS. 49 and 50.

This display is continued till the empty cassette is removed.

Thus, the segment indicating the cassette 22, and the segments $S_4$, $S_{11}$, $S_{19}$, $S_{28}$ and $S_{29}$ indicating a configuration of the copy machine are lit continuously. The segment indicating the cassette 22a and the segments ($S_9$, $S_{10}$) indicating the empty flicker.

In this way, which cassette is empty is distinctively displayed. Therefore, supplying paper to the cassette is easy.

Let us assume that the cassette 22 is empty when the manual guide 24a has been set, and the cassette 22a is selected.

Figure 52:
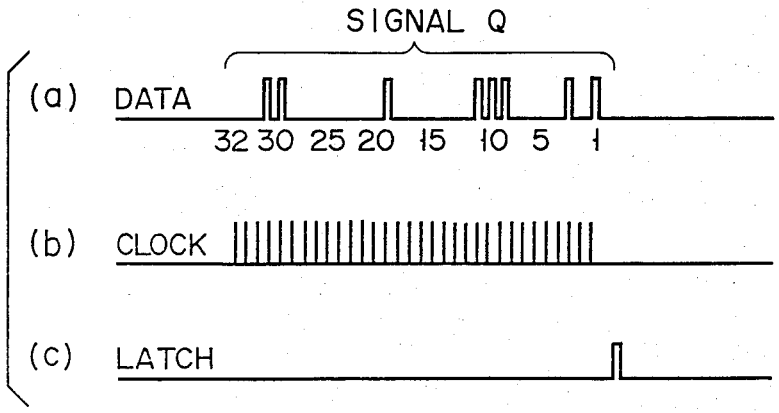
FIGS. 52–55 show timing charts useful in explaining the operation of the copy machine of FIG. 1.
Figure 54:
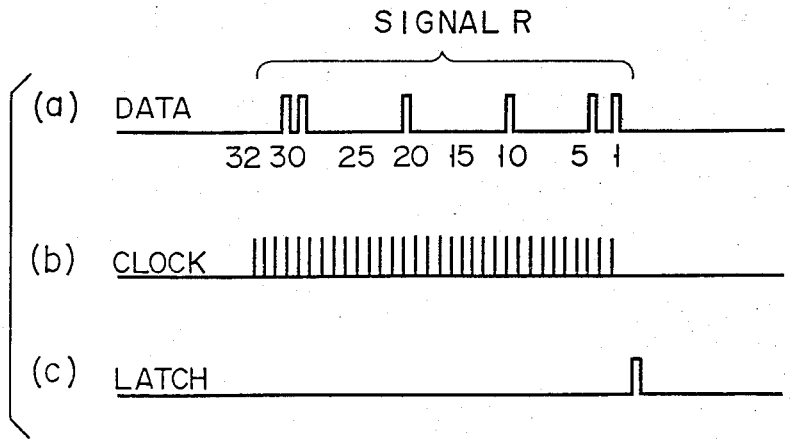

If the main control section 47 senses such state at time $t_{27}$ in FIG. 58, it immediately produces a signal Q (including a data signal and a clock signal) and a latch signal, as shown in FIG. 52. After time $T_3$ (time $t_{28}$ in FIG. 58), the main control section 47 produces a signal R (including a data signal and a clock signal) as shown in FIG. 54 and a latch signal.

Figure 53:
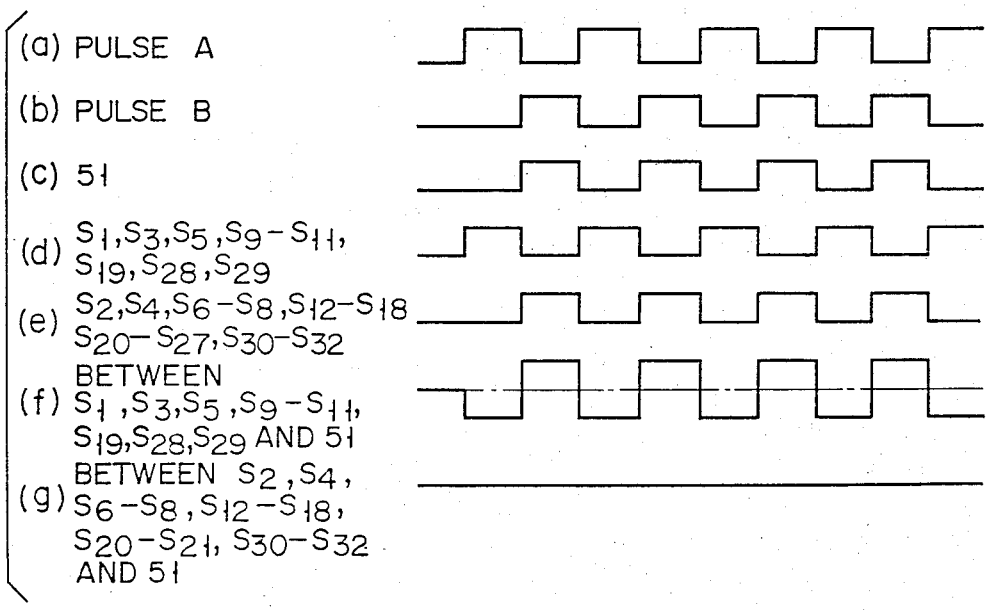
Figure 55:
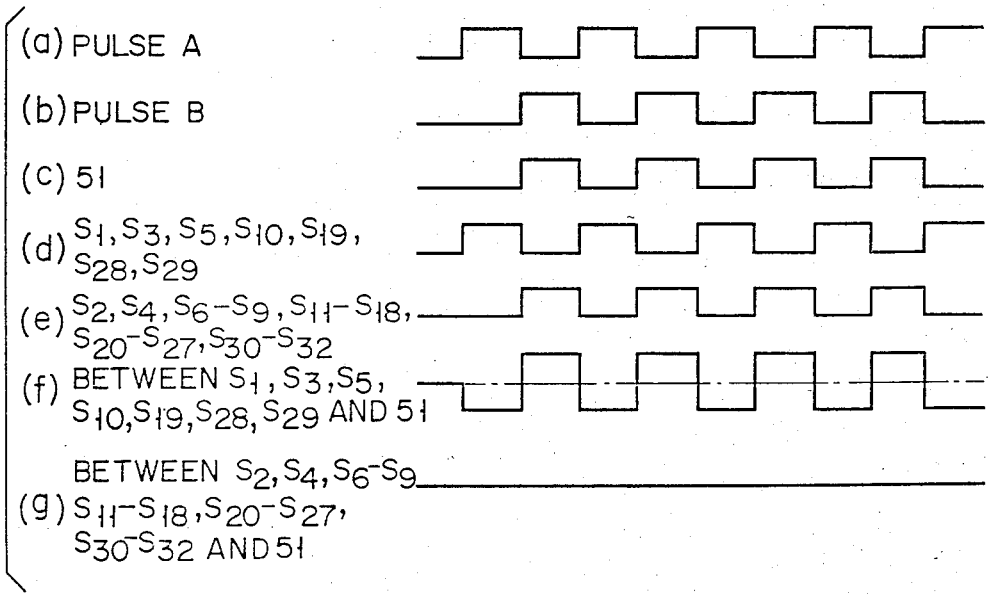

At times $t_{27}$ and $t_{28}$, the voltages applied to the segments are as shown in FIGS. 53 and 55.

Figure 56:
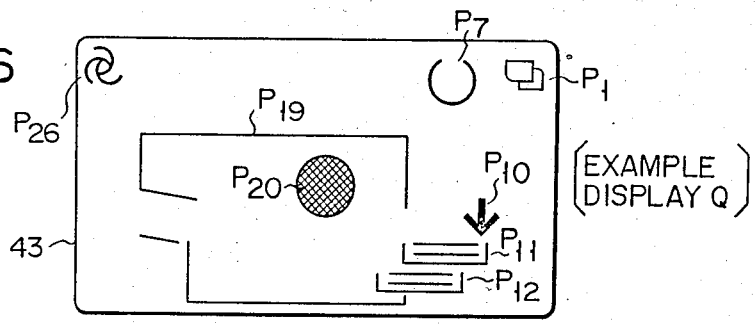
FIGS. 56 and 57 show plan views of figures displayed by the display panel of FIG. 3.
Figure 57:
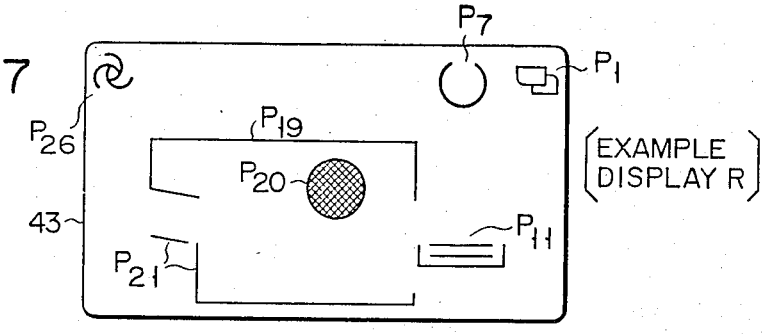
Figure 57:
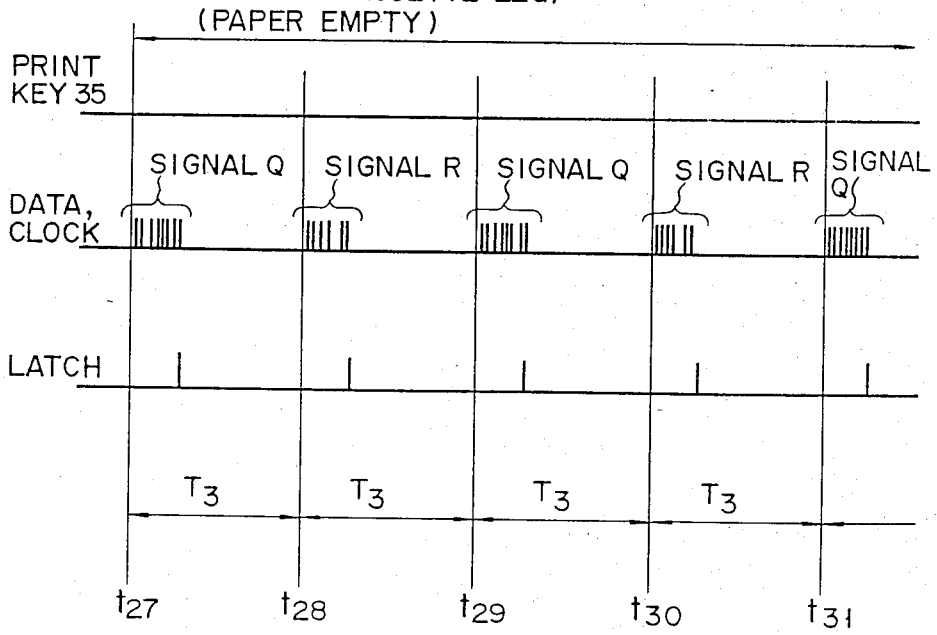

Accordingly, the LC display 43 displays the patterns as shown in FIGS. 56 and 57 (Examples Q and R) at the respective timings.

Specifically, the pattern $P_2$ representing the cassette 22 and the pattern $P_{10}$ flicker. This indicates that the cassette 22 is empty.

As described above, the pattern indicating the configuration of the copy machine and the patterns indicating the cassette 22*a* ($P_1$, $P_7$, $P_{12}$, $P_{21}$, $P_{19}$, $P_{20}$, $P_{26}$) are continuously lit. Therefore, it is easy to see which cassette is empty, and further to see that the manual paper feed is allowed if the cassette 22 is empty.

As seen from the foregoing, the patterns $P_{11}$ and $P_{12}$ for respectively indicating the cassettes 22 and 22*a* do not indicate which of the cassettes is selected by the select key 41, but indicate the cassette to be inspected when trouble occurs.

The display Examples are alternately repeated every $T_3$, as shown in the timing chart of FIG. 58, till paper is supplied to the empty cassette.

The description thus far made referring to FIGS. 6–58 is tabulated below.

TABLE 4

Figure 8:
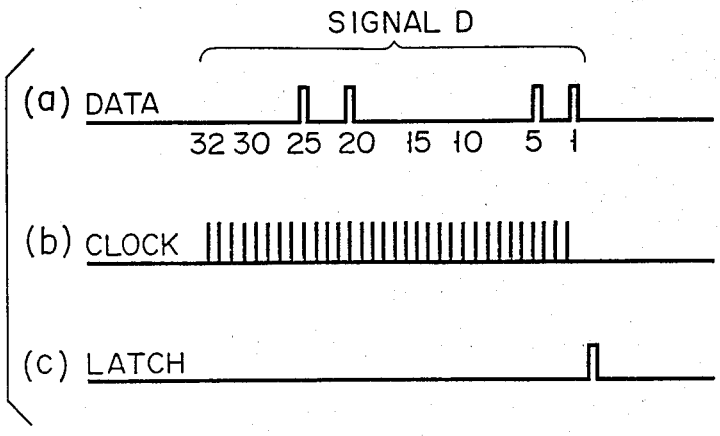
Figure 13:
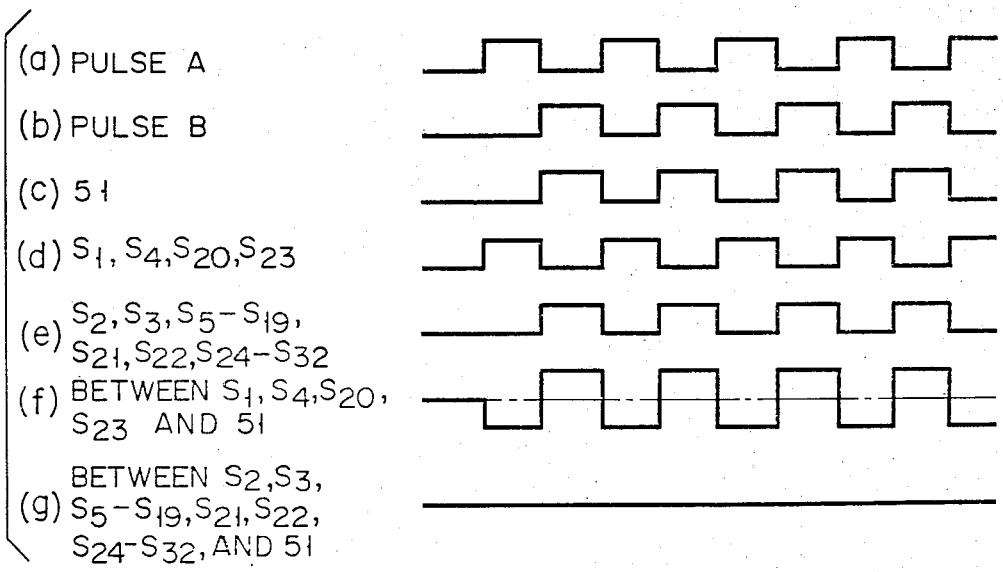
Figure 15:
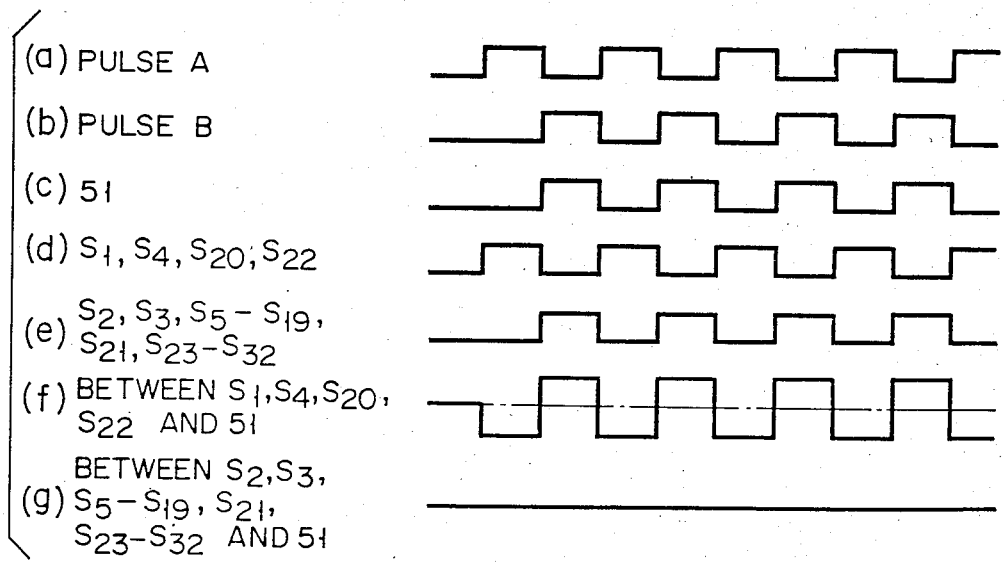
Figure 17:
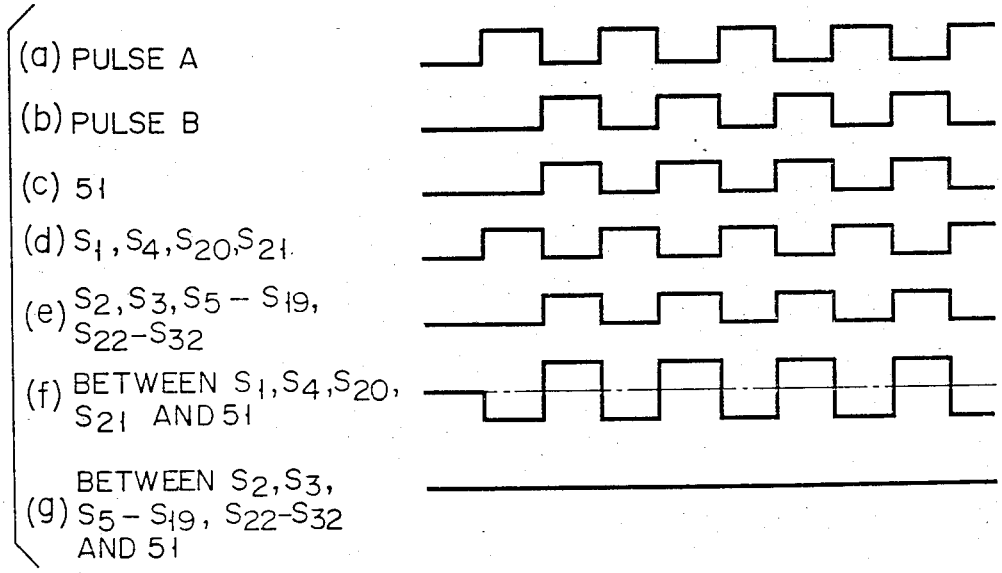
Figure 19:
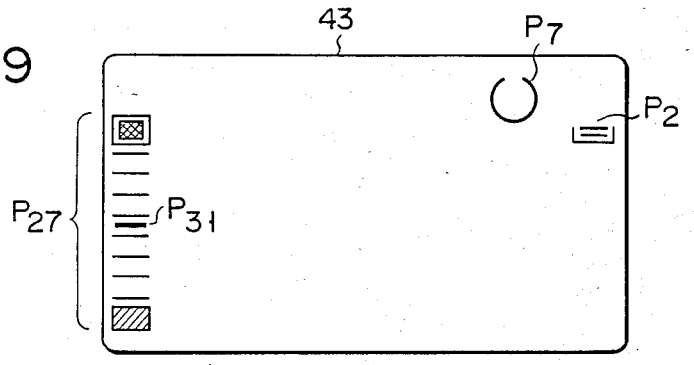
Figure 22:
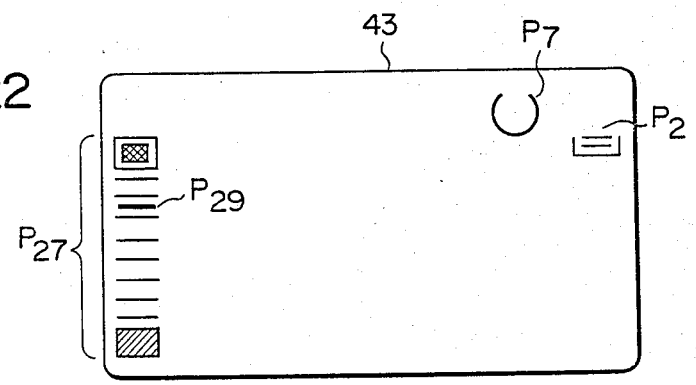
Figure 31:
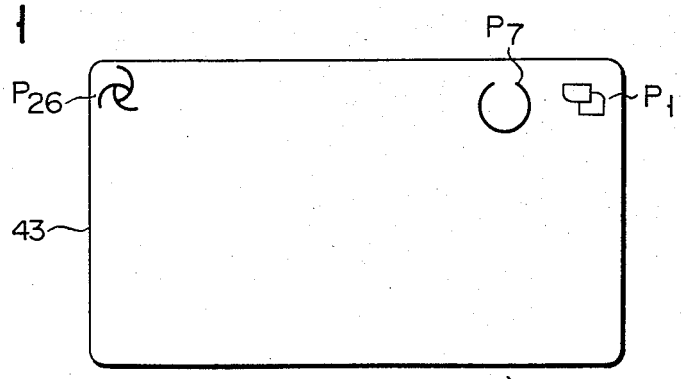
FIGS. 31–33 show plan views of figures displayed by the display panel of FIG. 3.
Figure 32:
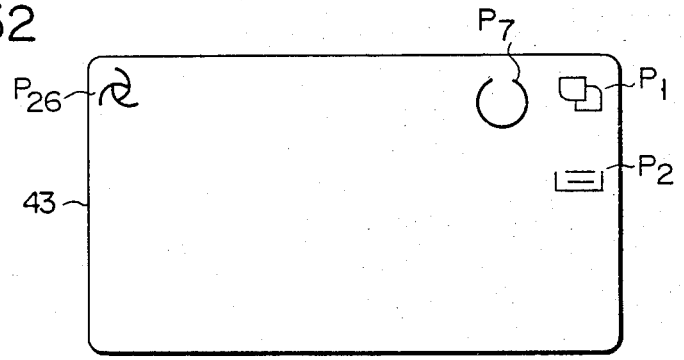
Figure 35:
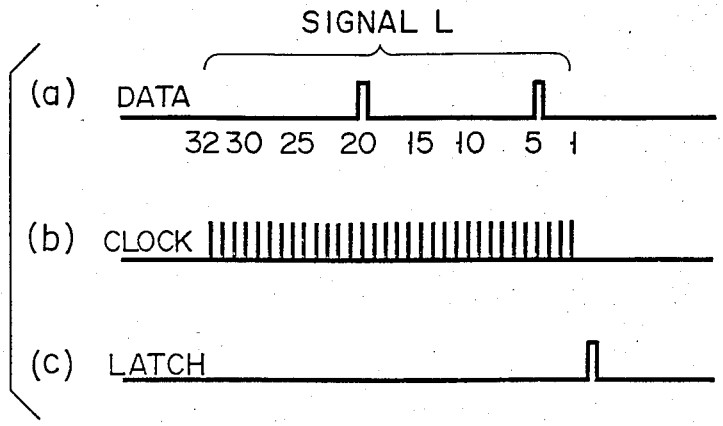
FIGS. 35 to 40 show timing charts for explaining the display operations of the copy machine of FIG. 1.
Figure 36:
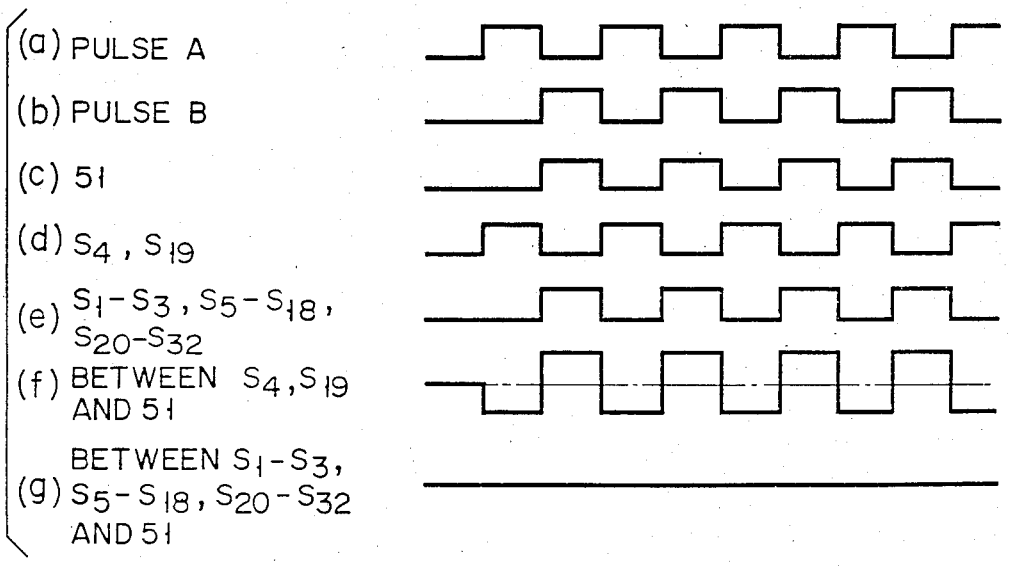
Figure 41:
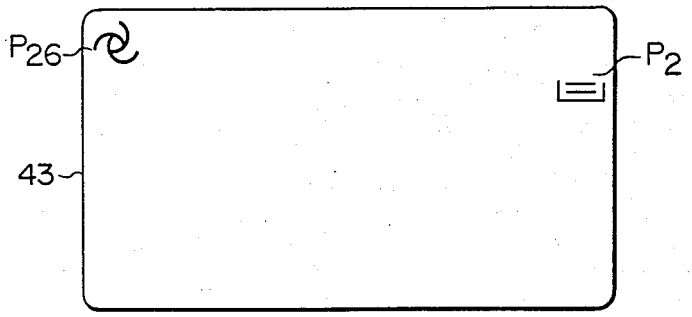
FIGS. 41–43 are plan views of figures displayed by the display panel of FIG. 3.
Figure 44:
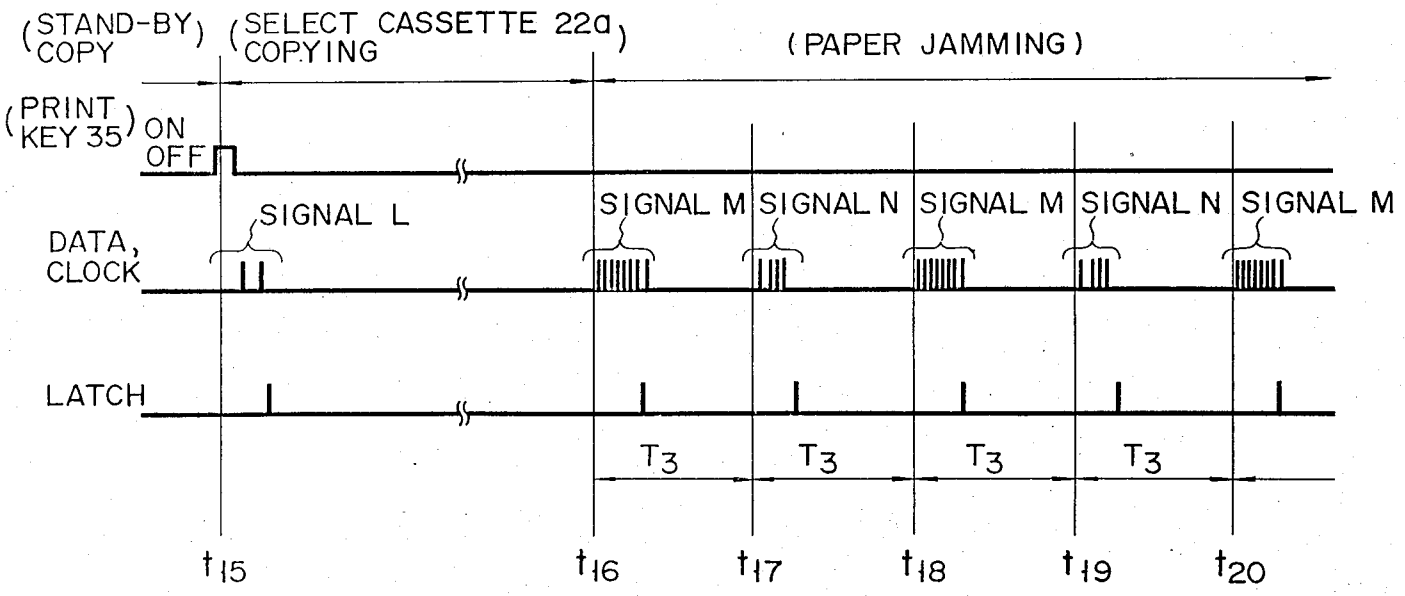
FIG. 44 shows a timing chart useful in explaining the switching operation of the displayed figures.

| Display contents | Signal from main controller 47 | Signal from LC driver 48 | Output Wave-form | Timing chart |
|---|---|---|---|---|
| Exposure mode/density | FIG. 6 | FIG. 7 | FIG. 18 | FIG. 24 |
| | FIG. 8 | FIG. 9 | FIG. 19 | |
| | FIG. 10 | FIG. 11 | FIG. 20 | |
| | FIG. 12 | FIG. 13 | FIG. 21 | |
| | FIG. 14 | FIG. 15 | FIG. 22 | |
| | FIG. 16 | FIG. 17 | FIG. 23 | |
| Exposure manual/automatic mode | FIG. 25 | FIG. 26 | FIG. 31 | FIG. 34 |
| | FIG. 27 | FIG. 28 | FIG. 32 | |
| | FIG. 29 | FIG. 30 | FIG. 33 | |
| Jamming | FIG. 35 | FIG. 36 | FIG. 41 | FIG. 44 |
| | FIG. 37 | FIG. 38 | FIG. 42 | |
| | FIG. 39 | FIG. 40 | FIG. 43 | |
| | FIG. 45 | FIG. 46 | FIG. 49 | FIG. 51 |
| | FIG. 47 | FIG. 48 | FIG. 50 | |
| | FIG. 52 | FIG. 53 | FIG. 56 | FIG. 58 |
| | FIG. 54 | FIG. 55 | FIG. 57 | |

As seen from the foregoing description, a paper feed mode, which is allowed in the machine at that time, is distinctively displayed. Further, the paper size in the automatic feed mode and whether or not the manual paper feed is allowed in the same mode are clearly displayed. The operability of the image-forming apparatus can be improved.

As described above, according to the present invention, whether each cassette is empty or not, can be displayed.

Therefore, it is possible to quickly supply paper to the empty cassette.

As described above, when paper feeding errors, jamming, etc. occurs, the occurrence of jamming, together with the cassette feeding the jammed paper are visually presented to the operator. Therefore, the operator can see a visual presentation of the problem and can quickly cope with jamming.

What is claimed is:

1. An image forming apparatus with automatic and manual sheet feed modes comprising:

first, detachable, sheet supply cassette means for containing sheets of a first predetermined size for automatic feeding;

second, detachable, sheet supply cassette means for containing sheets of a second predetermined size for automatic feeding, and for permitting manual feeding of a sheet from outside, said second sheet supply cassette means including a manual sheet supply guide which may be selectively moved between a first position, in which said guide permits manual feeding of said sheet from outside, and a second position, in which said guide permits automatic feeding of the sheets contained within said second sheet supply cassette means;

cassette selection means for supplying a command which designates from which of said first and second sheet supply cassette means sheets are to be fed;

first display means for displaying a manual feed mode;

second display means for displaying an automatic feed mode, and the size of the sheets which can be fed in such mode;

first control means for producing a first control signal which causes said second display means to operate in response to the second position assumed by said manual sheet supply guide, and in response to the command from said cassette selection means designating said first or second sheet supply cassette means;

second control means for producing a second control signal which causes said first display means to operate in response to the command from said cassette selection means designating said second sheet supply cassette means, and in response to the first position assumed by said manual sheet supply guide;

third control means for producing, when supplied with the command from said cassette selection means designating said first sheet supply cassette means while said first display means is operating, a third control signal which causes said second display means to operate, and a fourth control signal which causes said first display means to flash;

image data output means for outputting image data that is to be formed; and image forming means for transferring image data output from said image data output means onto a sheet supplied automatically or manually from one of said sheet supply cassette means and said manual sheet supply guide.

2. An apparatus as in claim 1 wherein said second sheet supply cassette means further includes means for detecting the position of said sheet supply guide and producing a signal indicative thereof, which signal is coupled to said first and second control means.

* * * * *